US005124221A

United States Patent [19]

Kato

[11] Patent Number: 5,124,221

[45] Date of Patent: Jun. 23, 1992

[54] ELECTROPHOTOGRAPHIC INORGANIC LIGHT-SENSITIVE MATERIAL WITH PARTICULAR BINDER

[75] Inventor: Eiichi Kato, Shizuoka, Japan

[73] Assignee: Fuji Photo Film Co., Ltd., Kanagawa, Japan

[21] Appl. No.: 577,714

[22] Filed: Sep. 5, 1990

[30] Foreign Application Priority Data

Sep. 6, 1989 [JP] Japan ..... 1-229381

[51] Int. Cl.[5] ..... G03G 5/087

[52] U.S. Cl. ..... 430/96; 430/49

[58] Field of Search ..... 430/49, 96

[56] References Cited

U.S. PATENT DOCUMENTS

| | | | |
|---|---|---|---|
| 4,105,448 | 8/1978 | Miyatuka et al. | 430/96 |
| 4,952,475 | 8/1990 | Kato et al. | 430/96 |
| 4,954,407 | 9/1990 | Kato et al. | 430/96 |
| 4,968,572 | 11/1990 | Kato et al. | 430/96 |
| 5,009,975 | 4/1991 | Kato et al. | 430/96 |
| 5,021,311 | 6/1991 | Kato et al. | 430/96 |
| 5,030,534 | 7/1991 | Kato et al. | 430/96 |
| 5,073,467 | 12/1991 | Kato et al. | 430/87 |

FOREIGN PATENT DOCUMENTS

| | | | |
|---|---|---|---|
| 0282275 | 9/1988 | European Pat. Off. . | |
| 0361063 | 4/1990 | European Pat. Off. | 430/96 |
| 0361514 | 4/1990 | European Pat. Off. . | |
| 0362804 | 4/1990 | European Pat. Off. | 430/96 |
| 0363928 | 4/1990 | European Pat. Off. | 430/96 |
| 220148 | 9/1988 | Japan | 430/96 |
| 96174 | 4/1990 | Japan | 430/96 |
| 135454 | 5/1990 | Japan | 430/96 |

*Primary Examiner*—Roland Martin
*Attorney, Agent, or Firm*—Sughrue, Mion, Zinn, Macpeak & Seas

[57] ABSTRACT

An electrophotographic light-sensitive material comprising a support having provided thereon at least one photoconductive layer containing an inorganic photoconductive substance and a binder resin, wherein the binder resin comprises:

at least one resin (A) having a weight average molecular weight of from $1\times10^3$ to $2\times10^4$ and containing not less than 30% by weight of a copolymer component corresponding to a repeating unit represented by the general formula (I) described below and having at least one acidic group as specified in the specification at one of the terminals of the main chain thereof:

(I)

wherein $a_1$, $a_2$ and $R_1$ are as defined in the specification; and at least one copolymer resin (B) having a weight average molecular weight of from $5\times10^4$ to $1\times10^6$ and formed from at least a monofunctional macromonomer (M) having a weight average molecular weight of not more than $2\times10^4$ and a monomer represented by the general formula (V) described below, said macromonomer (M) formed from at least one polymerizable component corresponding to a repeating unit represented by the general formulae (IVa) and (IVb) described below, and at least one polymerizable component containing at least one acidic group as defined in the specification, and said macromonomer (M) having a polymerizable double bond group represented by the general formula (III) described below bonded to only one terminal of the main chain of the polymer:

(III)

wherein $X_0$, $c_1$ and $c_2$ are as defined in the specification:

(IVa)

(IVb)

wherein $X_1$, $Q_1$ $d_1$, $d_2$ and $Q_0$ are as defined in the specification:

(V)

wherein $X_2$, $Q_2$, $e_1$ and $e_2$ are as defined in the specification, and wherein the content of the acidic group in the resin (A) is from 0.5% by weight to 15% by weight.

11 Claims, No Drawings

ELECTROPHOTOGRAPHIC INORGANIC LIGHT-SENSITIVE MATERIAL WITH PARTICULAR BINDER

FIELD OF THE INVENTION

The present invention relates to an electrophotographic light-sensitive material, and more particularly to an electrophotographic light-sensitive material which is excellent in electrostatic characteristics, moisture resistance, and durability.

BACKGROUND OF THE INVENTION

An electrophotographic light-sensitive material may have various structures depending upon the characteristics required or an electrophotographic process to be employed.

An electrophotographic system in which the light-sensitive material comprises a support having thereon at least one photoconductive layer and, if necessary, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if desired, transfer.

Furthermore, a process using an electrophotographic light-sensitive material as an offset master plate precursor for direct plate making is widely practiced.

Binders which are used for forming the photoconductive layer of an electrophotographic light-sensitive material are required to be excellent in the film-forming properties by themselves and the capability of dispersing photoconductive powder therein. Also, the photoconductive layer formed using the binder is required to have satisfactory adhesion to a base material or support. Further, the photoconductive layer formed by using the binder is required to have various excellent electrostatic characteristics such as high charging capacity, small dark decay, large light decay, and less fatigue before light-exposure and also have an excellent image forming properties, and the photoconductive layer stably maintains these electrostatic properties to change of humidity at the time of image formation.

Binder resins which have been conventionally used include silicone resins (e.g., JP-B-34-6670, the term "JP-B" as used herein means an "examined Japanese patent publication"), styrene-butadiene resins (e.g., JP-B-35-1960), alkyd resins, maleic acid resins, polyamides (e.g., JP-B-35-11219), polyvinyl acetate resins (e.g., JP-B-41-2425), vinyl acetate copolymers (e.g., JP-B-41-2426), and acrylic resins (JP-B-35-1216), acrylic acid ester copolymers (e.g., JP-B-35-1219, JP-B-36-8510, and JP-B-41-13946).

However, in the electrophotographic light-sensitive materials using these binder resins, there are various problems such as 1) the affinity of the binder with photoconductive powders is poor thereby reducing the dispersibility of the coating composition containing them, 2) the charging property of the photoconductive layer containing the binder is low, 3) the quality (in particular, the dot image reproducibility and resolving power) of the imaged portions of duplicated images is poor, 4) the image quality is liable to be influenced by the environmental conditions (e.g., high temperature and high humidity or low temperature and low humidity) at the formation of duplicated images, and 5) the photoconductive layer is insufficient in film strength and adhesion, which causes, when the light-sensitive material is used for an offset master, peeling off of the photoconductive layer, etc. at offset printing resulting in decrease of the number of prints.

For improving the electrostatic characteristics of a photoconductive layer, various approaches have hitherto been taken. For example, incorporation of a compound having an aromatic ring or a furan ring containing a carboxy group or a nitro group either alone or in combination with a dicarboxylic anhydride in a photoconductive layer is disclosed in JP-B-42-6878 and JP-B-45-3073. However, the thus improved electrophotographic light-sensitive materials are yet insufficient in electrostatic characteristics and, in particular light-sensitive materials having excellent light decay characteristics have not yet been obtained. Thus, for compensating the insufficient sensitivity of these light-sensitive materials, an attempt has been made to incorporate a large amount of a sensitizing dye in the photoconductive layer. However, light-sensitive materials containing a large amount of a sensitizing dye undergo considerable deterioration of whiteness to reduce the quality as a recording medium, sometimes causing deterioration in dark decay characteristics, whereby satisfactory reproduced images are not obtained.

On the other hand, JP-A-60-10254 (the term "JP-A" as used herein means an "unexamined published Japanese patent application") discloses a method for using a binder resin for a photoconductive layer by controlling the average molecular weight of the resin. More specifically, JP-A-60-10254 discloses a technique for improving the electrostatic characteristics (in particular, reproducibility in repeated use as a PPC light-sensitive material), humidity resistance, etc., of the photoconductive layer by using an acrylic resin having an acid value of from 4 to 50 and an average molecular weight of from $1\times10^3$ to $1\times10^4$ and an acrylic resin having an acid value of from 4 to 50 and an average molecular weight of from $1\times10^4$ to $2\times10^5$.

Furthermore, lithographic printing master plates using electrophotographic light-sensitive materials have been extensively investigated. As binder resins for a photoconductive layer having both the eletrostatic characteristics as an electrophotographic light-sensitive material and the printing characteristics as a printing master plate, there are, for example, a combination of a resin having a molecular weight of from $1.8\times10^4$ to $10\times10^4$ and a glass transition point (Tg) of from 10° C. to 80° C. obtained by copolymerizing a (meth)-acrylate monomer and other monomers in the presence of fumaric acid and a copolymer composed of a (meth)-acrylate monomer and a copolymerizable monomer other than fumaric acid as disclosed in JP-B-50-31011, a terpolymer containing a (meth)acrylic acid ester unit with a substituent having a carboxylic acid group at least 7 atoms apart from the ester linkage as disclosed in JP-A-53-54027, a tetra- or pentapolymer containing an acrylic acid unit and a hydroxyethyl (meth)acrylate unit as disclosed in JP-A-54-20735 and JP-A-57-202544, and a terpolymer containing a (meth)acrylic ester unit with an alkyl group having from 6 to 12 carbon atoms as a substituent and a vinyl monomer containing a carboxyl group as disclosed in JP-A-58-68046. These resins are described to be effective to improve desensitizing property of the photoconductive layer.

However, none of these resins proposed have proved to be satisfactory for practical use in electrostatic characteristics such as charging property, dark charge retention, and photosensitivity, and the surface smoothness of the photoconductive layer.

Also, the practical evaluations on conventional binder resins which are said to be developed for electrophotographic lithographic master plates have found that they have problems in the aforesaid electrostatic characteristics, background staining of prints, etc.

For solving these problems, JP-A-63-217354 and JP-A-64-70761 disclose that the smoothness and the electrostatic characteristics of a photoconductive layer can be improved and images having no background staining are obtained by using a low-molecular weight resin (molecular weight of from 1,000 to 10,000) containing from 0.05 to 10% by weight a copolymer component having an acid group in the side chain of the copolymer and by using the same resin but having an acid group at the terminal of the main chain of the polymer as the binder resin, respectively, and also U.S. Pat. No. 4,871,638, JP-A-63-220148, JP-A-63-220149, JP-A-1-100554, JP-A-1-102573, and JP-A-1-116643 disclose that the film strength of a photoconductive layer can be sufficiently increased to improve the printing durability without reducing the aforesaid characteristics by using the aforesaid low-molecular weight resin in combination with a high-molecular weight resin (molecular weight of 10,000 or more) and by utilizing a cross-linking reaction, respectively.

However, it has been found that, even in the case of using these resins, it is yet insufficient to keep the stable performance in the case of greatly changing the environmental conditions from high-temperature and high-humidity to low-temperature and low-humidity. In particular, in a scanning exposure system using a semiconductor laser beam, the exposure time becomes longer and also there is a restriction on the exposure intensity as compared to a conventional overall simultaneous exposure system using a visible light, and hence a higher performance has been required for the electrostatic characteristics, in particular, the dark charge retention characteristics and photosensitivity.

Further, when the scanning exposure system using a semiconductor laser beam is applied to hitherto known light-sensitive materials for electrophotographic lithographic printing master plates, various problems may occur in that the difference between $E_{1/2}$ and $E_{1/10}$ is particularly large and thus it is difficult to reduce the remaining potential after exposure, which results in severe fog formation in duplicated images, and when employed as offset masters, edge marks of originals pasted up appear on the prints, in addition to the insufficient electrostatic characteristics described above.

SUMMARY OF THE INVENTION

The present invention has been made for solving the problems of conventional electrophotographic light-sensitive materials as described above and meeting the requirement for the light sensitive materials.

An object of the present invention is to provide an electrophotographic light-sensitive material having stable and excellent electrostatic characteristics and giving clear good images even when the environmental conditions during the formation of duplicated images are changed to low-temperature and low-humidity or to high-temperature and high-humidity.

Another object of the present invention is to provide a CPC electrophotographic light-sensitive material having excellent electrostatic characteristics and showing less environmental dependency.

A further object of the present invention is to provide an electrophotographic light-sensitive material effective for a scanning exposure system using a semiconductor laser beam.

A still further object of the present invention is to provide an electrophotographic lithographic printing master plate forming neither background stains nor edge marks of originals pasted up on the prints.

Other objects of the present invention will become apparent from the following description and examples.

It has been found that the above described objects of the present invention are accomplished by an electrophotographic light-sensitive material comprising a support having provided thereon at least one photoconductive layer containing an inorganic photo-conductive substance and a binder resin, wherein the binder resin comprises at least one resin (A) having a weight average molecular weight of from $1\times10^3$ to $2\times10^4$ and containing not less than 30% by weight of a copolymer component corresponding to a repeating unit represented by the general formula (I) described below and having at least one acidic group selected from the group consisting of $-PO_3H_2$, $-SO_3H$, $-COOH$, $-OH$,

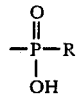

(wherein R represents a hydrocarbon group or —OR′ (wherein R′ represents a hydrocarbon group)) and a cyclic acid anhydride-containing group at one of the terminals of the main chain thereof;

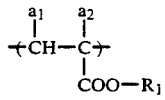

(I)

wherein $a_1$ and $a_2$ each represents a hydrogen atom, a halogen atom, a cyano group or a hydrocarbon group; and $R_1$ represents a hydrocarbon group; and at least one copolymer resin (B) having a weight ,average molecular weight of from $5\times10^4$ to $1\times10^6$ and formed from at least a monofunctional macromonomer (M) having a weight average molecular weight of not more than $2\times10^4$ and a monomer represented by the general formula (V) described below, the macromonomer (M) comprising at least one polymerizable component corresponding to a repeating unit represented by the general formulae (IVa) and (IVb) described below, and at least one polymerizable component containing at least one acidic group selected from —COOH, $-PO_3Hz$, $-SO_3H$, —OH,

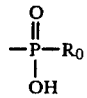

(wherein $R_0$ represents a hydrocarbon group or $-OR_0'$ (wherein $R_0'$ represents a hydrocarbon group)), —CHO, and an acid anhydride-containing group, and the macromonomer (M) having a polymerizable double bond group represented by the general formula (III) described below bonded to only one terminal of the main chain of the polymer;

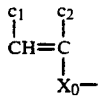

(III)

wherein $X_0$ represents —COO , —OCO—, —$CH_2$OCO—, —$CH_2$COO—, —O—, —$SO_2$—, —CO—, —CONHCOO—, —CONHCONH—,

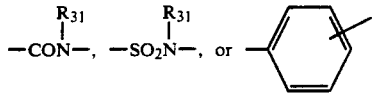

(wherein $R_{31}$ represents a hydrogen atom or a hydrocarbon group), and $c_1$ and $c_2$, which may be the same or different, each represents a hydrogen atom, a halogen atom, a cyano group, a hydrocarbon group, —COO—$Z_1$ or —COO—$Z_1$ bonded via a hydrocarbon group (wherein $Z_1$ represents a hydrogen atom or a hydrocarbon group which may be substituted);

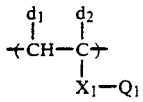

(IVa)

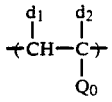

(IVb)

wherein $X_1$ has the same meaning as $X_0$ in the general formula (III); $Q_1$ represents an aliphatic group having from 1 to 18 carbon atoms or an aromatic group having from 6 to 12 carbon atoms; $d_1$ and $d_2$, which may be the same or different, have the same meaning as $c_1$ and $c_2$ in the general formula (III); and $Q_0$ represents —CN, —$CONH_2$, or

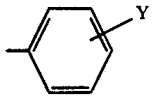

wherein Y represents a hydrogen atom, a halogen atom, an alkoxy group or —$COOZ_2$ (wherein $Z_2$ represents an alkyl group, an aralkyl group, or an aryl group));

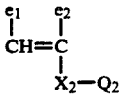

(V)

wherein $X_2$ has the same meaning as $X_1$ in the general formula (IVa); $Q_2$ has the same meaning as $Q_1$ in the general formula (IVa); and $e_1$ and $e_2$, which may be the same of different, have the same meaning as $c_1$ and $c_2$ in the general formula (III).

DETAILED DESCRIPTION OF THE INVENTION

The binder resin which can be used in the present invention comprises at least (A) a low-molecular weight resin (hereinafter referred to as resin (A)) containing the copolymerizable component having the specific repeating unit and having the acidic group (the term "acidic group" as used herein also includes a cyclic acid anhydride-containing group, unless otherwise indicated) at one of the terminals of the main chain thereof and (B) a high-molecular weight resin (hereinafter referred to as resin (B)) composed of a graft type copolymer formed from at least a monofunctional macromonomer (M) and a monomer represented by the general formula (V).

According to a preferred embodiment of the present invention, the low molecular weight resin (A) is a low molecular weight resin (hereinafter referred to as resin (A')) having an acidic group bonded to the terminal of the polymer main chain thereof and containing a methacrylate component having a specific substituent containing a benzene ring which has a specific substituent(s) at the 2-position or 2- and 6- positions thereof or a specific substituent containing a naphthalene ring represented by the following general formula (IIa) or (IIb):

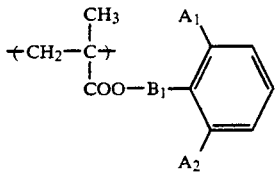

(IIa)

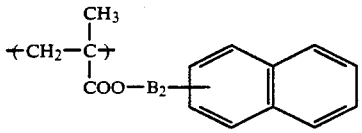

(IIb)

wherein $A_1$ and $A_2$ each represents a hydrogen atom, a hydrocarbon group having from 1 to 10 carbon atoms, a chlorine atom, a bromine atom, —$COD_1$ or —$COOD_2$, wherein $D_1$ and $D_2$ each represents a hydrocarbon group having from 1 to 10 carbon atoms, provided that both $A_1$ and $A_2$ do not simultaneously represent hydrogen atoms; and $B_1$ and $B_2$ each represents a mere bond or a linking group containing from 1 to 4 linking atoms, which connects —COO— and the benzene ring.

According to another preferred embodiment of the present invention, the high molecular weight resin (B) is a high molecular weight resin (hereinafter referred to as resin (B')) of a graft type copolymer further having at least one acidic group selected from —$PO_3H_2$, —$SO_3H$, —COOH, —OH,

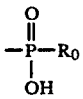

(wherein $R_0$ has the same meaning as R defined above) and a cyclic acid anhydride-containing group bonded to the terminal of the main chain of the polymer.

In the present invention, the acidic group bonded to the terminal of the polymer main chain of the resin (A)

which contains the specific copolymer component is adsorbed onto stoichiometrical defects of an inorganic photoconductive substance, and the resin has a function to improve covering power for the photoconductive substance due to its low molecular weight, to sufficiently cover the surface thereof, whereby electron traps of the photoconductive substance can be compensated for and humidity resistance can be greatly improved, while assisting the photoconductive substance to be sufficiently dispersed without agglomeration. On the other hand, the resin (B) serves to sufficiently heighten the mechanical strength of a photoconductive layer, which may be insufficient in case of using the resin (A) alone, without damaging the excellent electrophotographic characteristics attained by the use of the resin (A).

It is believed that the excellent characteristics of the electrophotographic light-sensitive material may be obtained by employing the resin (A) and the resin (B) as binder resins for inorganic photoconductive substance, wherein the weight average molecular weight of the resins and the content and position of the acidic group therein are specified, whereby the strength of interactions between the inorganic photoconductive substance and the resins can be appropriately controlled. More specifically, it is believed that the electrophotographic characteristics and mechanical strength of the layer as described above can be greatly improved by the fact that the resin (A) having a relatively strong interaction to the inorganic photoconductive substance selectively adsorbs thereon; whereas, in the resin (B) which has a weak activity compared with the resin (A), the acidic group bonded to the specific position of the polymer main chain thereof mildly interacts with the inorganic photoconductive substance to a degree which does not damage the electrophotographic characteristics, and the long main molecular chain and the molecular chains of the graft portion mutually interact.

In case of using the resin (A'), the electrophotographic characteristics, particularly, $V_{10}$, D.R.R. and $E_{1/10}$ of the electrophotographic material can be furthermore improved as compared with the use of the resin (A). While the reason for this is not fully understood, it is believed that the polymer molecular chain of the resin (A') suitably arranges on the surface of inorganic photoconductive substance such as zinc oxide in the layer depending on the plane effect of the benzene ring having a substituent at the ortho position or the naphthalene ring which is an ester component of the methacrylate whereby the above described improvement is achieved.

On the other hand, when the resin (B') is employed, the electrophotographic characteristics, particularly, D.R.R. and $E_{1/10}$ of the electrophotographic material are further improved without damaging the excellent characteristics due to the resin (A), and these preferred characteristics are almost maintained in the case of greatly changing the environmental conditions from high-temperature and high-humidity to low-temperature and low-humidity.

Further, according to the present invention, the smoothness of the photoconductive layer is improved.

On the other hand, when an electrophotographic light-sensitive material having a photoconductive layer with a rough surface is used as an electrophotographic lithographic printing master plate, the dispersion state of inorganic particles as photoconductive substance and a binder resin is improper and thus a photoconductive layer is formed in a state containing aggregates of the photoconductive substance, whereby the surface of the non-image portions of the photoconductive layer is not uniformly and sufficiently rendered hydrophilic by applying thereto an oil-desensitizing treatment with an oil-desensitizing solution to cause attaching of printing ink at printing, which results in the formation of background stains in the non-image areas of prints.

According to the present invention, the interaction of adsorption and covering between the inorganic photoconductive substance and the binder resins is suitably performed and the sufficient mechanical strength of the photoconductive layer is achieved by the combination of the resins described above.

In the resin (A), the weight average molecular weight is suitably from $1\times10^3$ to $2\times10^4$, preferably from $3\times10^3$ to $1\times10^4$, the content of the copolymer component corresponding to the repeating unit represented by the general formula (I) is suitably not less than 30% by weight, preferably from 50% to 97% by weight, and the content of the acidic group bonded to the terminal of the polymer main chain is suitably from 0.5% to 15% by weight, preferably from 1% to 10% by weight.

In the resin (A'), the content of the methacrylate copolymer component corresponding to the repeating unit represented by the general formula (IIa) or (IIb) is suitably not less than 30% by weight, preferably from 50% to 97% by weight, and the content of the acidic group bonded to the terminal of the polymer main chain is suitably from 0.5% to 15% by weight, preferably from 1% to 10% by weight based on the weight of the resin (A').

The glass transition point of the resin (A) is preferably from −20° C. to 110° C., and more preferably from −10° C. to 90° C.

On the other hand, the weight average molecular weight of the resin (B) is suitably from $5\times10^4$ to $1\times10^6$, preferably from $8\times10^4$ to $5\times10^5$. The content of the monofunctional macromonomer in the resin (B) is preferably from 1% to 70% by weight, and the content of the monomer represented by the general formula (V) therein is preferably from 30% to 99% by weight.

The glass transition point of the resin (B) is preferably from 0° C. to 110° C., and more preferably from 20° C. to 90° C.

If the molecular weight of the resin (A) is less than $1\times10^3$, the film-forming ability thereof is undesirably reduced, whereby the photoconductive layer formed cannot keep a sufficient film strength, while if the molecular weight thereof is larger than $2\times10^4$, the fluctuations of electrophotographic characteristics (in particular, dark decay retention and photosensitivity of $E_{1/10}$) of the photoconductive layer become somewhat large, and thus the effect for obtaining stable duplicated images according to the present invention is reduced under severe conditions of high temperature and high-humidity or low-temperature or low-humidity.

If the content of the acidic group in the resin (A) is less than 0.5% by weight, the resulting electrophotographic light-sensitive material has too low initial potential to provide a sufficient image density. If, on the other hand, it is more than 15% by weight, dispersibility of the photoconductive substance is reduced, the smoothness of the photoconductive layer and the electrophotographic characteristics thereof under a high humidity condition are deteriorated. Further, background stains are increased when it is used as an offset master.

If the molecular weight of the resin (B) is less than $5\times10^4$, a sufficient film strength may not be maintained. On the other hand, the molecular weight thereof is larger than $1\times10^6$, the dispersibility of the photoconductive substance is reduced, the smoothness of the photoconductive layer is deteriorated, and image quality of duplicated images (particularly reproducibility of fine lines and letters) is degradated. Further, the background stains increase in case of using as an offset master.

Further, if the content of the monofunctional macromonomer is less than 1.0% by weight in the resin (B), electrophotographic characteristics (particularly dark decay retention and photosensitivity) may be reduced and the fluctuations of electrophotographic characteristics of the photoconductive layer, particularly that containing a spectral sensitizing dye for the sensitization in the range of from near-infrared to infrared become large due to change the environmental conditions. The reason for this is considered that the construction of the polymer becomes that similar to a conventional homopolymer or random copolymer resulting from a very small amount of the macromonomer portion present therein to constitute the graft part.

On the other hand, the content of the macromonomer is more than 70% by weight, the copolymerizability of the macromonomer with other monomers corresponding to other copolymerizable components may become insufficient, and the sufficient electrophotographic characteristics can not be obtained as the binder resin.

Now, the resin (A) which can be used in the present invention will be explained in detail below.

The resin (A) used in the present invention contains at least one repeating unit represented by the general formula (I) as a copolymer component as described above.

In the general formula (I), $a_1$ and $a_2$ each represents a hydrogen atom, a halogen atom (e.g., chlorine and bromine), a cyano group or a hydrocarbon group, preferably an alkyl group having from 1 to 4 carbon atoms (e.g., methyl, ethyl, propyl and butyl); and $R_1$ represents a hydrocarbon group, preferably a substituted or unsubstituted alkyl group having from 1 to 18 carbon atoms (e.g., methyl, ethyl, propyl, butyl, pentyl, hexyl, octyl, decyl, dodecyl, tridecyl, tetradecyl, 2-chloroethyl, 2-bromoethyl, 2-cyanoethyl, 2-hydroxyethyl, 2-methoxyethyl, 2-ethoxyethyl, and 3-hydroxypropyl), a substituted or unsubstituted alkenyl group having from 2 to 18 carbon atoms (e.g., vinyl, allyl, isopropenyl, butenyl, hexenyl, heptentyl, and octenyl), a substituted or unsubstituted aralkyl group having from 7 to 12 carbon atoms (e.g., benzyl, phenethyl, naphthylmethyl, 2-naphthylethyl, methoxybenzyl, ethoxybenzyl, and methylbenzyl), a substituted or unsubstituted cycloalkyl group having from 5 to 8 carbon atoms (e.g., cyclopentyl, cyclohexyl, and cycloheptyl), or a substituted or unsubstituted aryl group (e.g., phenyl, tolyl, xylyl, mesityl, naphthyl, methoxyphenyl, ethoxyphenyl, fluorophenyl, difluorophenyl, bromophenyl, chlorophenyl, dichlorophenyl, iodophenyl, methoxycarbonylphenyl, ethoxycarbonylphenyl, cyanophenyl, and nitrophenyl).

More preferably, the copolymer component corresponding to the repeating unit represented by the general formula (I) is a methacrylate component having the specific aryl group represented by the following general formula (IIa) or (IIb):

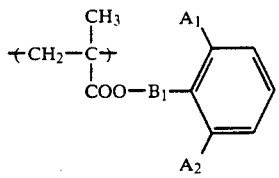

(IIa)

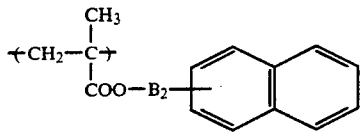

(IIb)

wherein $A_1$ and $A_2$ each represents a hydrogen atom, a hydrocarbon group having from 1 to 10 carbon atoms, a chlorine atom, a bromine atom, $-COD_1$ or $-COOD_2$, wherein $D_1$ and $D_2$ each represents a hydrocarbon group having from 1 to 10 carbon atoms, provided that both $A_1$ and $A_2$ do not simultaneously represent hydrogen atoms; and $B_1$ and $B_2$ each represents a direct bond or a linking group containing from 1 to 4 linking atoms, which connects —COO— and the benzene ring.

In the general formula (IIa), $A_1$ and $A_2$ each preferably represents a hydrogen atom, a chlorine atom, a bromine atom, an alkyl group having from 1 to 4 carbon atoms (e.g., methyl, ethyl, propyl, and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl), an aryl group (e.g., phenyl, tolyl, xylyl, bromophenyl, methoxyphenyl, chlorophenyl, and dichlorophenyl), $-COD_1$ or $-COOD_2$, wherein $D_1$ and $D_2$ each preferably represents any of the above-recited hydrocarbon groups, provided that $A_1$ and $A_2$ do not simultaneously represent hydrogen atoms.

In the general formula (IIa), $B_1$ is a direct bond or linking group containing from 1 to 4 linking atoms, e.g., $$\text{+}CH_2\text{+}_{n1}$$

($n_1$ represents an integer of 1, 2 or 3), $-CH_2OCO-$, $-CH_2CH_2OCO-$, $$\text{+}CH_2O\text{+}_{n2}$$

($n_2$ (n2 represents an integer of 1 or 2), and $-CH_2CH_2O-$, which connects —COO— and the benzene ring.

In the general formula (IIb), $B_2$ has the same meaning as $B_1$ in the general formula (IIa).

Specific examples of the copolymer component corresponding to the repeating unit represented by the general formula (IIa) or (IIb) which can be used in the resin (A') according to the present invention are set forth below, but the present invention should not be construed as being limited thereto. In the following formulae, $T_1$ and $T_2$ each represents Cl, Br or I; $R_{11}$ represents $-C_aH_{2a+1}$ or

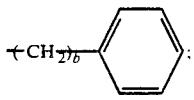
a represents an integer of from 1 to 4; b represents an integer of from 0 to 3; and c represents an integer of from 1 to 3.
i-1)
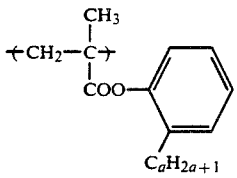
i-2)
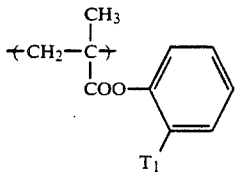
i-3)
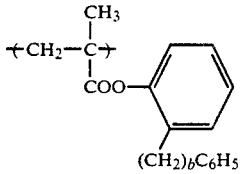
i-4)
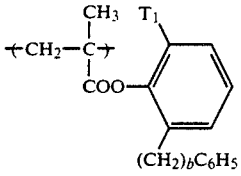
i-5)
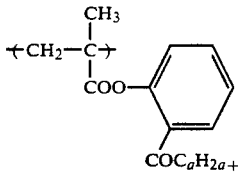
i-6)
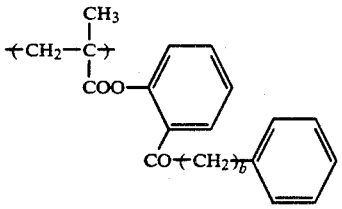
i-7)
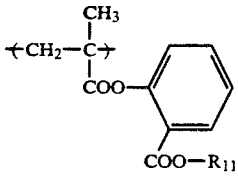
-continued
i-8)
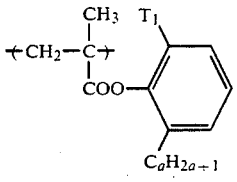
i-9)
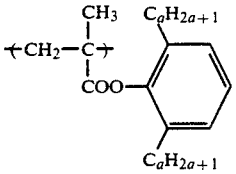
i-10)
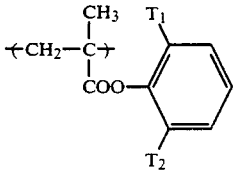
i-11)
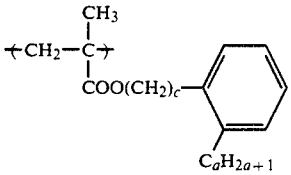
i-12)
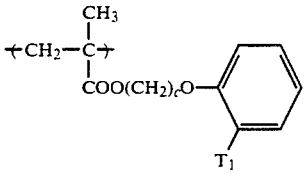
i-13)
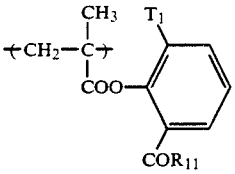
i-14)
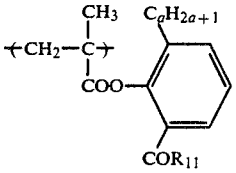
i-15)
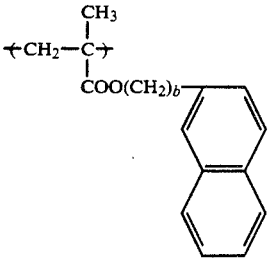

-continued i-16)

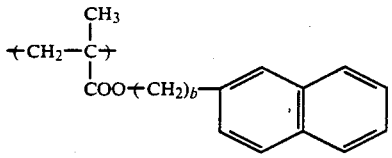

i-17)

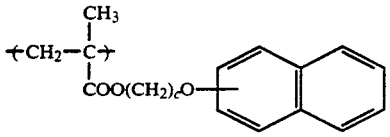

i-18)

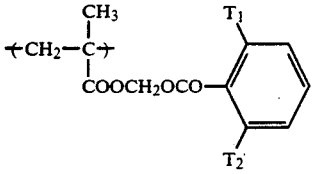

i-19)

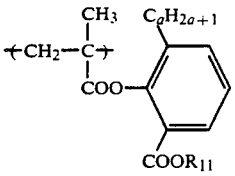

i-20)

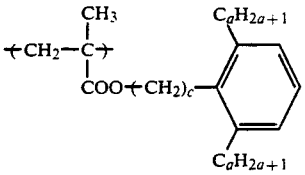

The acidic group which is bonded to one of the terminals of the polymer main chain in the resin (A) according to the present invention preferably includes $-PO_3H_2$, $-SO_3H$, —COOH,

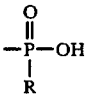

(wherein R is as defined above) and a cyclic acid anhydride-containing group.

In the acidic group

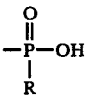

above, R represents a hydrocarbon group or —OR', wherein R' represents a hydrocarbon group. The hydrocarbon group represented by R or R' preferably includes an aliphatic group having from 1 to 22 carbon atoms (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and a substituted or unsubstituted aryl group (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl).

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphtnalene-dicarboxylic acid anhydride ring, pyridinedicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

The above-described acidic group may be bonded to one of the polymer main chain terminals either directly or via an appropriate linking group.

The linking group can be any group for connecting the acidic group to the polymer main chain terminal. Specific examples of suitable linking group include

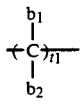

(wherein $b_1$ and $b_2$, which may be the same or different, each represents a hydrogen atom, a halogen atom (e.g., chlorine, and bromine), a hydroxyl group, a cyano group, an alkyl group (e.g., methyl, ethyl, 2-chloroethyl, 2-hydroxyethyl, propyl, butyl, and hexyl), an aralkyl group (e.g., benzyl, and phenethyl), an aryl group (e.g., phenyl),

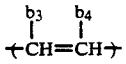

(wherein $b_3$ and $b_4$ each has the same meaning as defined for $b_1$ or $b_2$ above),

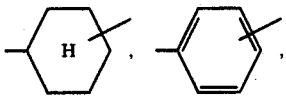

—O—, —S—,

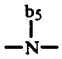

(wherein $b_5$ represents a hydrogen atom or a hydrocarbon group preferably having from 1 to 12 carbon atoms (e.g., methyl, ethyl, propyl, butyl, hexyl, octyl, decyl, dodecyl, 2-methoxyethyl, 2-chloroethyl, 2-cyanoethyl, benzyl, methylbenzyl, chlorobenzyl, methoxybenzyl, phenethyl, phenyl, tolyl, chlorophenyl, methoxyphenyl, and butylphenyl), —CO—, —COO—, —OCO—,

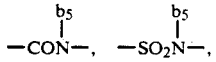

—$SO_2$—, —NHCONH—, —NHCOO—, —$NHSO_2$—, —CONHCOO—, —CONHCONH—, a heterocyclic ring, preferably a 5-membered or 6-membered ring containing at least one of an oxygen atom, a sulfur atom and a nitrogen atom as a hetero atom or a condensed ring thereof (e.g., thiophene, pyridine, furan, imidazole, piperidine, and morpholine),

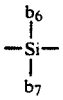

(wherein $b_6$ and $b_7$, which may be the same or different, each represents a hydrocarbon group or —$Ob_8$ (wherein $b_8$ represents a hydrocarbon group)), and a combination thereof. Suitable example of the hydrocarbon group represented by $R_6$, $R_7$ or $R_8$ include those described for $R_5$.

The binder resin (A) preferably contains from 1% to 20% by weight of a copolymer component having a heat- and/or photocurable functional group in addition to the copolymer component represented by the general formula (I) (including that represented by the general formula (IIa) or (IIb)), in view of achieving higher mechanical strength.

The term "heat- and/or photocurable functional group" as used herein means a functional group capable of inducing a curing reaction of resin on application of at least one of heat and light.

Specific examples of the photocurable functional group include those used in conventional photosensitive resins known as photocurable resins as described, for example, in Hideo Inui and Gentaro Nagamatsu, *Kankosei Kobunshi,* Kodansha (1977), Takahiro Tsunoda, *Shin-Kankosei Jushi,* Insatsu Gakkai Shuppanbu (1981), G. E. Green and B. P. Strak, *J. Macro. Sci. Reas. Macro. Chem.,* C 21 (2), pp. 187 to 273 (1981–82), and C. G. Rattey, *Photopolymerization of Surface Coatings,* A Wiley Interscience Pub. (1982).

The heat curable functional group which can be used includes functional groups excluding the above-specified acidic groups. Examples of the heat-curable functional groups usable are described, for example, in Tsuyoshi Endo, *Netsukokasei Kobunshi no Seimitsuka,* C.M.C. (1986), Yuji Harasaki, *Saishin Binder Gijutsu Binran,* Chapter II–I, Sogo Gijutsu Center (1985), Takayuki Ohtsu, *Acryl Jushi no Gosei Sekkei to Shin-Yotokaihatsu,* Chubu Kei-ei Kaihatsu Center Shuppanbu (1985), and Eizo Ohmori, *Kinosei Acryl Kei Jushi,* Techno System (1985).

Specific examples of the heat curable functional group which can used include —OH, SH, —$NH_2$ —$NHR_2$ (wherein $R_2$ represents a hydrocarbon group, for example, a substituted or unsubstituted alkyl group having from 1 to 10 carbon atoms (e.g., methyl, ethyl, propyl, butyl, hexyl, octyl, decyl, 2-chloroethyl, 2-methoxyethyl, and 2-cyanoethyl), a substituted or unsubstituted cycloalkyl group having from 4 to 8 carbon atoms (e.g., cyclopentyl, cyclohexyl and cycloheptyl), a substituted or unsubstituted aralkyl group having from 7 to 12 carbon atoms (e.g., benzyl, phenethyl, 3-phenylpropyl, chlorobenzyl, methylbenzyl, and methoxybenzyl), and a substituted or unsubstituted aryl group (e.g., phenyl, tolyl, xylyl, chlorophenyl, bromophenyl, methoxyphenyl, and naphthyl)),

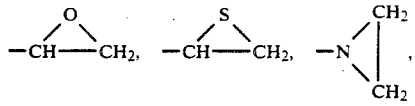

—$CONHCH_2OR_3$ (wherein $R_3$ represents a hydrogen atom or an alkyl group having from 1 to 8 carbon atoms (e.g., methyl, ethyl, propyl, butyl, hexyl, and octyl), —N=C=O and

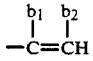

(wherein $b_1$ and $b_2$ each represents a hydrogen atom, a halogen atom (e.g., chlorine and bromine) or an alkyl group having from 1 to 4 carbon atoms (e.g., methyl and ethyl)).

Another examples of the functional group include polymerizable double bond groups, for example, $CH_2$=CH—,

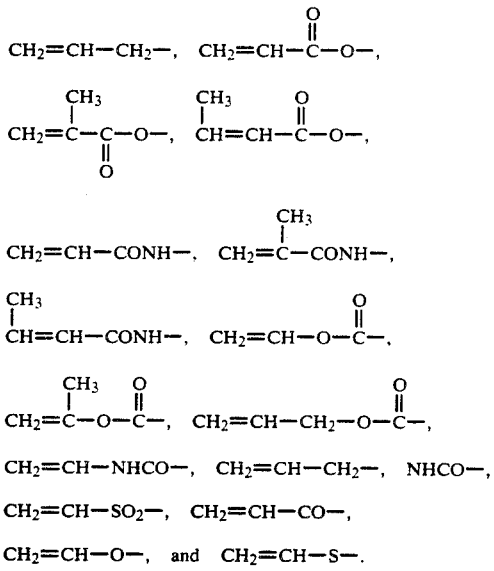

In order to introduce at least one functional group selected from the heat- and/or photocurable functional groups into the binder resin according to the present invention, a method comprising introducing the functional group into a polymer by high molecular reaction or a method comprising copolymerizing at least one monomer containing at least one of the functional groups with a monomer corresponding to the repeating unit of the general formula (I) (including that of the general formula (IIa) or (IIb)) can be employed.

The above-described high molecular reaction can be carried out by using conventionally known low molecular synthesis reactions. For the details, reference can be made to, e.g., Nippon Kagakukai (ed.), *Shin-Jikken Kaqaku Koza,* Vol. 14, *Yuki Kaqobutsu no Gosei to*

*Hanno* (I) to (V), Maruzen K. K. and Yoshio Iwakura and Keisuke Kurita, *Hannosei Kobunshi*, and literatures cited therein.

Suitable examples of the monomers containing the functional group capable of inducing heat- and/or photocurable reaction include vinyl compounds which are copolymerizable with the monomers corresponding to the repeating unit of the general formula (I) and contain the above-described functional group. More specifically, compounds similar to the acidic group containing component described for the macromonomer (M) hereinafter described which contains the above-described functional group in their substituent are illustrated.

Specific examples of the heat- and/or photocurable functional group-containing repeating units are set forth below, but the present invention should not be construed as being limited thereto. In the following formulae, $R_{11}$, a, d and e each has the same meaning as defined above; $P_1$ and $P_3$ each represents —H or —$CH_3$; $R_{14}$ represents —CH=$CH_2$ or —$CH_2CH$=$CH_2$; $R_{15}$ represents —CH=$CH_2$,

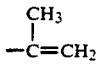

or —CH=$CHCH_3$; $R_{16}$ represents —CH=$CH_2$, —$CH_2CH$=$CH_2$,

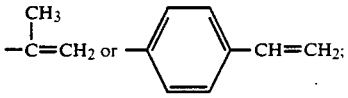

Z represents S or O; $T_3$ represents —OH or —$NH_2$; h represents an integer of from 1 to 11; and i represents an integer of from 1 to 10.

ii-1)

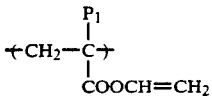

ii-2)

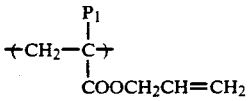

ii-3)

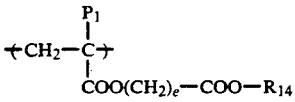

ii-4)

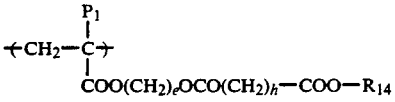

ii-5)

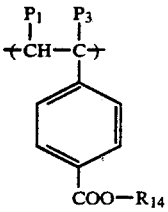

-continued ii-6)

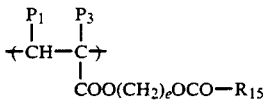

ii-7)

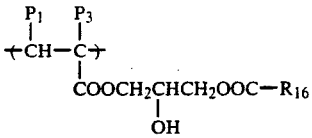

ii-8)

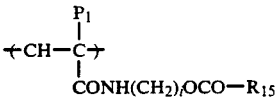

ii-9)

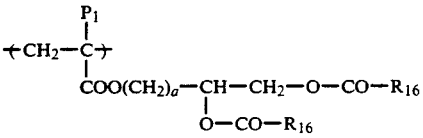

ii-10)

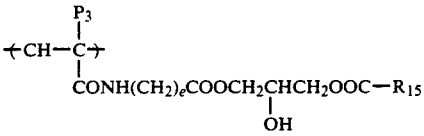

ii-11)

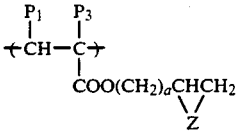

ii-12)

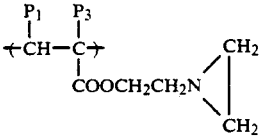

ii-13)

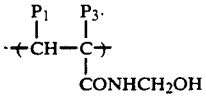

ii-14)

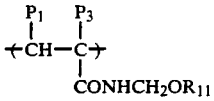

ii-15)

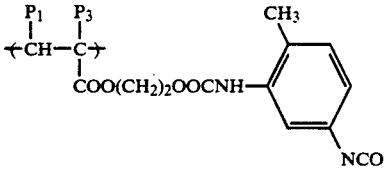

ii-16)

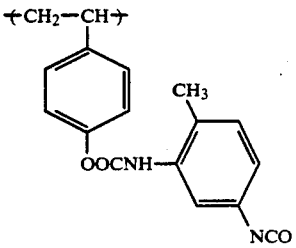

-continued ii-17)

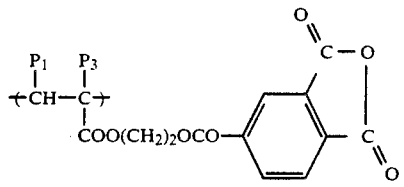

ii-18)

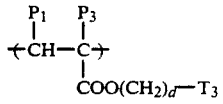

ii-19)

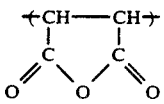

ii-20)

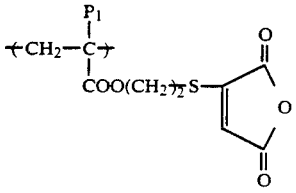

The resin (A) according to the present invention may further comprise other copolymer monomers as copolymer components in addition to the monomer corresponding to the repeating unit of the general formula (I) (including that of the general formula (IIa) or (IIb)), and, if desired, the heat- and/or photocurable functional group-containing monomer. Examples of such monomers include, in addition to methacrylic acid esters, acrylic acid esters and crotonic acid esters other than those represented by the general formula (I), α-olefins, vinyl or allyl esters of carboxylic acids (including, e.g., acetic acid, propionic acid, butyric acid, and valeric acid, as examples of the carboxylic acids), arylonitrile, methacrylonitrile, vinyl ethers, itaconic acid esters (e.g., dimethyl itaconate, and diethyl itaconate), acrylamides, methacrylamides, styrenes (e.g., styrene, vinyltoluene, chlorostyrene, hydroxystyrene, N,N-dimethylaminomethylstyrene, methoxycarbonylstyrene, methanesulfonyloxystyrene, and vinylnaphthalene), and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinyltetrazole, and vinyloxazine).

The resin (A) according to the present invention, in which the specific acidic group is bonded to only one terminal of the polymer main chain, can easily be prepared by an ion polymerization process, in which a various kind of a reagent is reacted at the terminal of a living polymer obtained by conventionally known anion polymerization or cation polymerization; a radical polymerization process, in which radical polymerization is performed in the presence of a polymerization initiator and/or a chain transfer agent which contains the specific acidic group in the molecule thereof; or a process, in which a polymer having a reactive group (for example, an amino group, a halogen atom, an epoxy group, and an acid halide group) at the terminal obtained by the above-described ion polymerization or radical polymerization is subjected to a high molecular reaction to convert the terminal to the specific acidic group.

For the details, reference can be made to, e.g., P. Dreyfuss and R. P. Quirk, *Encycl. Polym. Sci. Eng.*, Vol. 7, p. 551 (1987), Yoshiki Nakajo and Yuya Yamashita, *Senryo to Yakuhin*, Vol. 30, p. 232 (1985), Akira Ueda and Susumu Nagai, *Kagaku to Kogyo*, Vol. 60, p. 57 (1986) and literature references cited therein.

Specific examples of the chain transfer agent to be used include mercapto compounds containing the acidic group or the reactive group capable of being converted to the acidic group (e.g., thioglycolic acid, thiomalic acid, thiosalicyclic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mecaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, 2-mercapto-3-pyridinol, 4-(2-mercaptoethyloxycarbonyl) phthalic anhydride, 2-mercaptoethylphosphonic acid, and monomethyl 2-mercaptoethylphosphonate), and alkyl iodide compounds containing the acidic group or the acidic-group forming reactive group (e.g., iodoacetic acid, iodopropionic acid, 2-iodoethanol, 2-iodoethanesulfonic acid, and 3-iodopropanesulfonic acid). Preferred of them are mercapto compounds.

Specific examples of the polymerization initiators containing the acidic group or the reactive group include 4,4'-azobis(4-cyanovaleric acid), 4,4'-azobis(4-cyanovaleric chloride), 2,2'-azobis(2-cyanopropanol), 2,2'-azobis(2-cyanopentanol), 2,2'-azobis[2-methyl-N-(2-hydroxyethyl)propionamide], 2,2'-azobis{2-methyl-N-[1,1-bis(hydroxymethyl)-2-hydroxy-ethyl]propionamide}, 2,2'-azobis{2-[1-(2-hydroxyethyl)-2-imidazolin-2-yl]propane}, 2,2'-azobis[2-(2-imidazolin-2-yl)propane], and 2,2'-azobis[2-(4,5,6,7-tetrahydro-1H-1,3-diazepin-2-yl)-propane].

The chain transfer agent or polymerization initiator is usually used in an amount of from 0.5 to 15 parts by weight, preferably from 2 to 10 parts by weight, per 100 parts by weight of the total monomers.

Now, the resin (B) will be described in detail with reference to preferred embodiments below.

The monofunctional macromonomer (M) which is a copolymerizable component of the graft type copolymer resin (B) for use in the present invention is described hereinafter in greater detail.

The monofunctional macromonomer (M) is a macromonomer having a weight average molecular weight of not more than $2\times10^4$, comprising at least one copolymerizable component corresponding to a repeating unit represented by the general formula (IVa) or (IVb) described above and at least one copolymerizable component having at least one specific acidic group (i.e., —COOH, —$PO_3H_2$, —$SO_3H$, —OH,

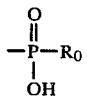

—CHO and/or an acid anhydride-containing group), and having a polymerizable double bond group represented by the general formula (III) described above bonded to only one terminal of the polymer main chain.

In the above described formulae (III), (IVa), and (IVb), the hydrocarbon groups represented by $c_1$, $c_2$, $X_0$, $d_1$, $d_2$, $X_1$, $Q_1$, and $Q_0$ each has the number of carbon atoms described above (as unsubstituted hydrocarbon group) and these hydrocarbon groups may have one or more substituents.

In the general formula (III), $X_0$ represents —COO—, —OCO—, —$CH_2OCO$—, —$CH_2COO$—, —O—, —$SO_2$—, —CO—, —CONHCOO—, —CONHCONH—,

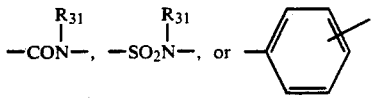

wherein $R_{31}$ represents a hydrogen atom or a hydrocarbon group, and preferred examples of the hydrocarbon group include an alkyl group having from 1 to 18 carbon atoms which may be substituted (e.g., methyl, ethyl, propyl, butyl, pentyl, hexyl, heptyl, octyl, decyl, dodecyl, hexadecyl, octadecyl, 2-chloroethyl, 2-bromoethyl, 2-cyanoethyl, 2-methoxycarbonylethyl, 2 methoxyethyl, and 3-bromo-(propyl), an alkenyl group having from 4 to 18 carbon atoms which may be substituted (e.g., 2-methyl-1-porpenyl, 2-butenyl, 2-pentenyl, 3-methyl-2-pentenyl, 1-pentenyl, 1-hexenyl, 2-hexenyl, and 4-methyl-2-hexcenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chloro phenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, and dodecyloylamidophenyl).

When $X_0$ represents

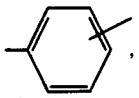

the benzene ring may have a substituent such as, for example, a halogen atom (e.g., chlorine and bromine), an alkyl group (e.g., methyl, ethyl, propyl, butyl, chloromethyl, methoxymethyl) and an alkoxy group (e.g., methoxy, ethoxy, propoxy, and butoxy).

In the general formula (III), $c_1$ and $c_2$, which may be the same or different, each represents a hydrogen atom, a halogen atom (e.g., chlorine and bromide), a cyano group, an alkyl group having from 1 to 4 carbon atoms (e.g., methyl, ethyl, propyl, and butyl), —COO—$Z_1$, or —$COOZ_1$ bonded via a hydrocarbon group (wherein $Z_1$ represents preferably a hydrogen atom, an alkyl group having from 1 to 18 carbon atoms, an alkenyl group having from 3 to 18 carbon atoms, an aralkyl group having from 7 to 18 carbon atoms, an alicyclic group having from 4 to 18 carbon atoms or an aryl group having from 6 to 18 carbon atoms, these groups may be substituted, and specific examples thereof are the same as those described above for $R_{31}$).

In the general formula (III), —COO—$Z_1$ may be bonded via a hydrocarbon group, and examples of the hydrocarbon group include a methylene, ethylene, and propylene group.

In the general formula (III), $X_0$ is more preferably —COO—, —OCO—, —$CH_2OCO$—, —$CH_2COO$—, —O—, —CONHCOO—, —CONHCONH—, —CONH—, —$SO_2NH$—, or

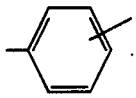

Also, $c_1$ and $c_2$, which may be the same or different, each represents more preferably a hydrogen atom, a methyl group, —$COOZ_3$, or —$CH_2COOZ_3$ (wherein $Z_3$ represents more preferably a hydrogen atom or an alkyl group having from 1 to 6 carbon atoms (e.g., methyl, ethyl, propyl, butyl, and hexyl)). Most preferably, one of $c_1$ and $c_2$ represents a hydrogen atom.

That is, specific examples of the polymerizable double bond represented by the general formula (III) include

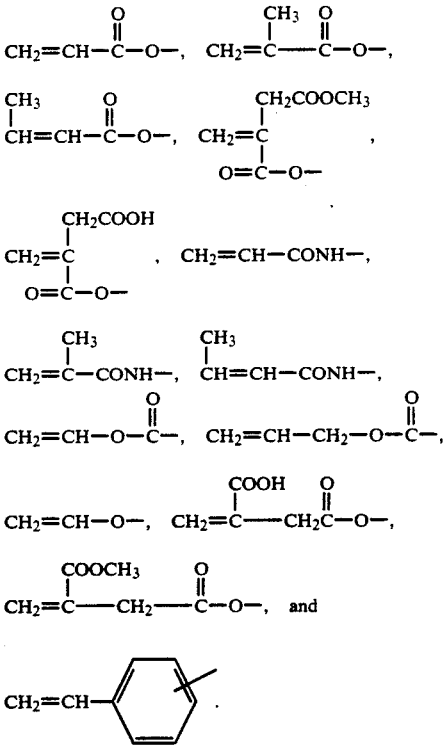

In the general formula (IVa) or (IVb), $X_1$ has the same meaning as $X_0$ in the general formula (III) and $d_1$ and $d_2$, which may be the same or different, have the same meanings as $c_1$ and $c_2$ in the general formula (III).

$Q_1$ represents an aliphatic group having from 1 to 18 carbon atoms or an aromatic group having from 6 to 12 carbon atoms.

Specific examples of the aliphatic group include an alkyl group having from 1 to 18 carbon atoms which may be substituted (e.g., methyl, ethyl, propyl, butyl, heptyl, hexyl, octyl, decyl, dodecyl, tridecyl, hexadecyl, octadecyl, 2-chloroethyl, 2-bromoethyl, 2-hydroxyethyl, 2-methoxyethyl, 2-ethoxyethyl, 2-cyanoethyl, 3-chloropropyl, 2-(trimethoxysilyl)ethyl, 2-tetrahydrofuryl, 2-thienylethyl, 2-N,N-dimethylaminoethyl, and 2-N,N-diethylaminoethyl), a cycloalkyl group having from 5 to 8 carbon atoms (e.g., cycloheptyl, cyclohexyl, and cyclooctyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, dichlorobenzyl, methylbenzyl, chloromethylbenzyl, dimethylbenzyl, trimethylbenzyl, and methoxybenzyl). Also, specific examples of the aromatic group include an aryl group having from 6 to 12 carbon atoms which may be substituted (e.g., phenyl, tolyl, xylyl, chlorophenyl, bromophenyl, dichlorophenyl, chloromethylphenyl, methoxyphenyl, methoxycarbonylphenyl, naphthyl, and chloronaphthyl).

In the general formula (IVa), $X_1$ represents preferably —COO—, —OCO—, —$CH_2$COO—, —$CH_2$OCO—, —O—, —CO—, —CONHCOO—, —CONHCONH—, —CONH—, $SO_2$NH—, or

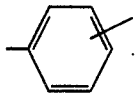

Also, preferred examples of $d_1$ and $d_2$ the same as those described above for $c_1$ and $C_2$ in the general formula (III).

In the general formula (IVb), $Q_0$ represents —CN, —$CONH_2$, or

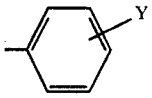

(wherein Y represents a hydrogen atom, a halogen atom (e.g., chlorine and bromine), an alkoxy group (e.g., methoxy, ethoxy, propoxy, and butoxy), or —$COOZ_2$ (wherein $Z_2$ represents an alkyl group having from 1 to 8 carbon atoms, an aralkyl group having from 7 to 12 carbon atoms or an aryl group)).

The monofunctional macromonomer (M) in the present invention may have two or more polymerizable components corresponding to a repeating unit represented by the general formula (IVa) and/or the polymerizable components corresponding to a repeating unit represented by the general formula (IVb). Also, when $Q_1$ in the general formula (IVa) is an aliphatic group having from 6 to 18 carbon atoms, it is preferred that the proportion of the aliphatic group is not higher than 20% by weight of the whole polymer components in the macromonomer (M).

Furthermore, when $X_1$ in the general formula (IVa) is —COO—, it is preferred that the proportion 0f the polymerizable component corresponding to a repeating unit represented by the general formula (IVa) is at least 30% by weight of the whole polymerizable components in the macromonomer (M).

As the polymerizable component having the acidic group (—COOH, —$PO_3H_2$, —$SO_3$H, —OH,

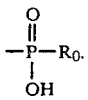

—CHO or an acid anhydride-containing group), which is copolymerized with the copolymerizable component corresponding to a repeating unit represented by the general formula (IVa) or (IVb) in the macromonomer (M), any vinyl compounds having the above described acidic group capable of being copolymerized with the copolymerizable component corresponding to a repeating unit represented by the general formula (IVa) or (IVb) can be used.

Examples of these vinyl compounds are described, for example, in *Kobunshi Data Handbood (Kisohen)*, edited by Kobunshi Gakkai, published by Baifukan K. K., 1986.

Specific examples thereof include acrylic acid, an α- and/or β-substituted acrylic acid (e.g., α-acetoxy compound, α-acetoxymethyl compound, α-aminomethyl compound, α-chloro compound, α-bromo compound, α-fluoro compound, α-tributylsilyl compound, α-cyano compound, β-chloro compound, β-bromo compound, β-fluoro compound, β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl 2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, dicarboxylic acids, half ester derivatives of alcohols at the vinyl group or allyl group, and compounds having the acidic group in the substituent of ester derivatives or amido derivatives of these carboxylic acids or sulfonic acids.

In

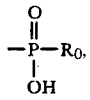

$R_0$ represents a hydrocarbon group or —$OR_0'$ and $R_0'$ represents a hydrocarbon group. Examples of these hydrocarbon groups are those described above.

With respect to the acid anhydride-containing group, those described above are also applied, and compounds containing —OH group include alcohols containing a vinyl group or an allyl group (e.g., allyl alcohol, methacrylates containing —OH group in an ester substituent thereof, and arylamides containing —OH group in an N-substituent thereof), hydroxyphenol, and methacrylates or amides containing a hydroxyphenyl group as a substituent.

Specific examples of the polymerizable component having the acidic group described above are set forth below, but the present invention should not be construed as being limited thereto. In the following formulae, $Q_1$ represents —H, —$CH_3$, —Cl, —Br, —CN, —$CH_2COOCH_3$, or —$CH_2$COOH; $Q_2$represents —H or —$CH_3$; j represents an integer of from 2 to 18; k represents an integer of from 2 to 5; l represents an integer of from 1 to 4; and m represents an integer of from 1 to 12.
(A-1)
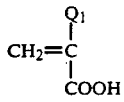
(A-2)
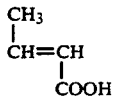
(A-3)
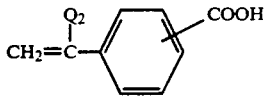
(A-4)
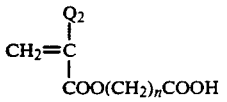
(A-5)
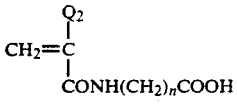
(A-6)
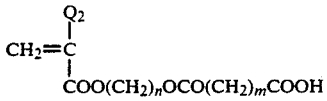
(A-7)
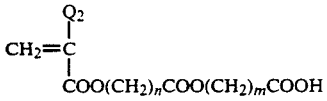
(A-8)
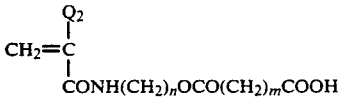
(A-9)
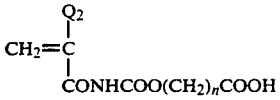
(A-10)
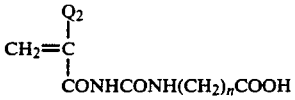
(A-11)
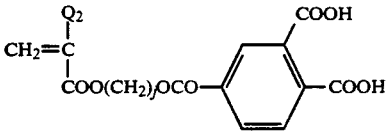
(A-12)
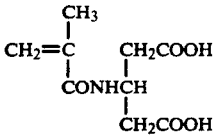
(A-13)
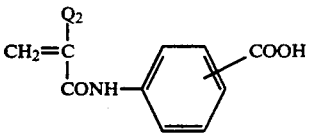
-continued
(A-14)
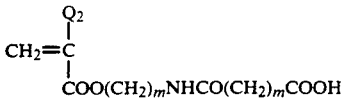
(A-15)
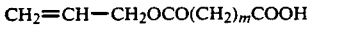
(A-16)
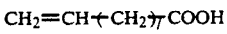
(A-17)
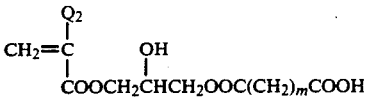
(A-18)
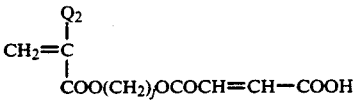
(A-19)
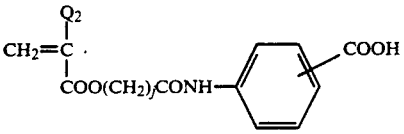
(A-20)
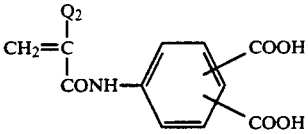
(A-21)
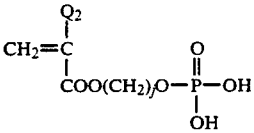
(A-22)
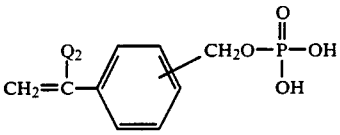
(A-23)
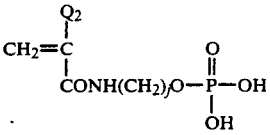
(A-24)
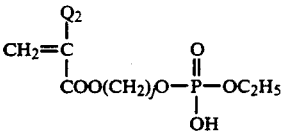
(A-25)
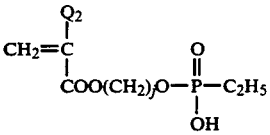
(A-26)
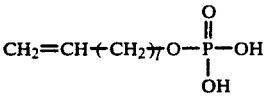
(A-27)
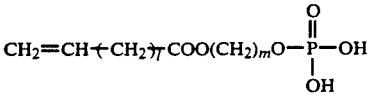

-continued
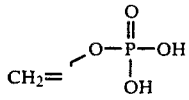
(A-28)
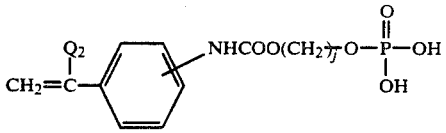
(A-29)
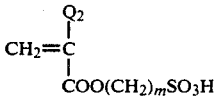
(A-30)
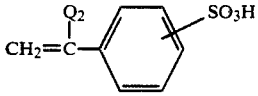
(A-31)
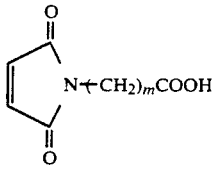
(A-32)
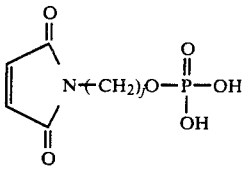
(A-33)
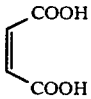
(A-34)
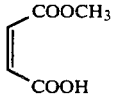
(A-35)
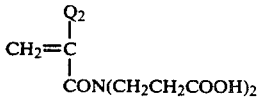
(A-36)
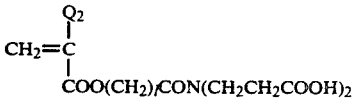
(A-37)
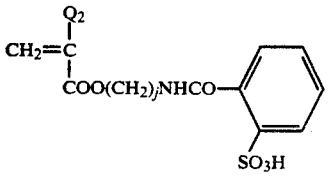
(A-38)
-continued
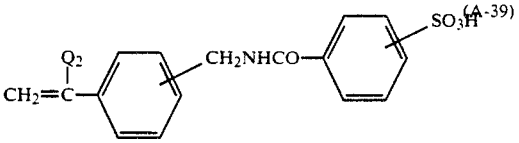
(A-39)
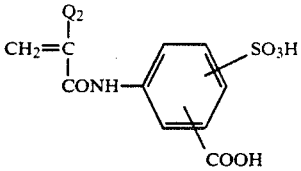
(A-40)
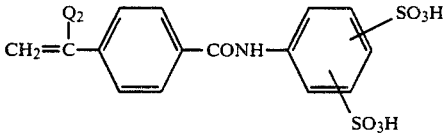
(A-41)
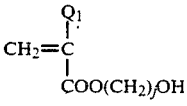
(A-42)
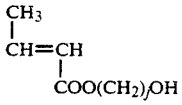
(A-43)
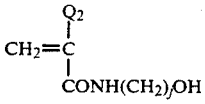
(A-44)
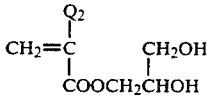
(A-45)
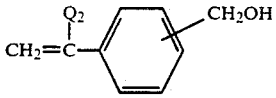
(A-46)
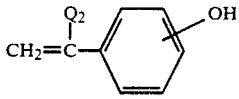
(A-47)
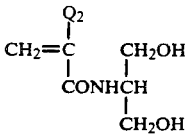
(A-48)
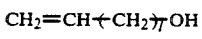
(A-49)
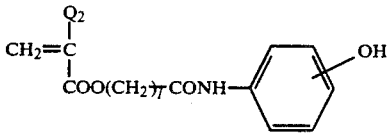
(A-50)
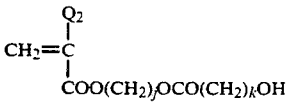
(A-51)

-continued $CH_2{=}CH{+}CH_2{+}_7COO(CH_2{+}_7OH$ (A-52)

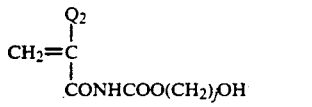
(A-53)

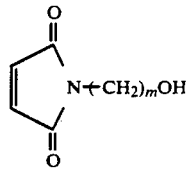
(A-54)

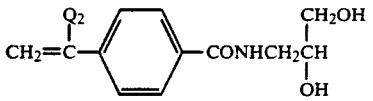
(A-55)

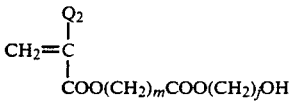
(A-56)

The content of the above described copolymerizable component having the acidic group contained in the macromonomer (M) is preferably from 0.5 to 50 parts by weight, and more preferably from 1 to 40 parts by weight per 100 parts by weight of the total copolymerizable components.

When the monofunctional macromonomer composed of a random copolymer having the acidic group exists in the resin (B) as a copolymer component, the total content of the acidic group-containing component contained in the total graft portions in the resin (B) is preferably from 0.1 to 10 parts by weight per 100 parts by weight of the total copolymer components in the resin (B). When the resin (B) has the acidic group selected from —COOH, $—SO_3H$, and $—PO_3H_2$, the total content of the acidic group in the graft portions of the resin (B) is more preferably from 0.1 to 5 parts by weight.

The macromonomer (M) may further contain other copolymer component(s) in addition to the described copolymer components.

As such a monomer corresponding to other polymer recurring unit, there are acrylonitrile, methacrylonitrile, acrylamides, methacrylamides, styrene, styrene derivatives (e.g., vinyltoluene, chlorostyrene, dichlorostyrene, bromostyrene, hydroxymethylstyrene, and N,N-dimethylaminomethylstyrene), and heterocyclic vinyl compounds (e.g., vinylpyridine, vinylimidazole, vinylpyrrolidone, vinylthiophene, vinylpyrazole, vinyldioxane and vinyloxazine).

When the macromonomer (M) contains other monomer described above, the content of the monomer is preferably from 1 to 20 parts by weight per 100 parts by weight of the total copolymer components in the macromonomer.

The macromonomer (M) for use in the present invention has a chemical structure that the polymerizable double bond group represented by the general formula (III) is bonded directly or through an appropriate linkage group to only one terminal of the main chain of the random polymer composed of at least the repeating unit represented by the general formula (IVa) and/or the repeating unit represented by the general formula (IVb) and the repeating unit having the specific acidic group.

The linkage group bonding the component represented by the general formula (III) to the component represented by the general formula (IVa) or (IVb) or the acidic group-containing component includes a carbon-carbon bond (single bond or double bond), carbon-hetero atom bond (examples of the hetero atom include oxygen, sulfur, nitrogen, and silicon), and a hetero atom-hetero atom bond, or an appropriate combination of these atomic groups.

Specific examples of the linkage group include a single linkage group selected from

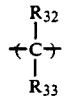

(wherein $R_{32}$ and $R_{33}$ each represents a hydrogen atom, a halogen atom (e.g., fluorine, chlorine, and bromine), a cyano group, a hydroxy group, or an alkyl group (e.g., methyl, ethyl, and propyl),

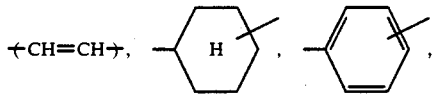

—O—, —S—,

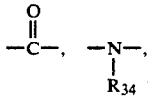

—N—, —COO—, $—SO_2—$,

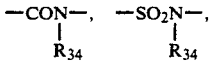

—NHCOO—, —NHCONH— and

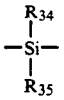

(wherein $R_{34}$ and $R_{35}$ each represents a hydrogen atom or the hydrocarbon group as described above for $Q_1$ in the general formula (IVa)) and a linkage group composed of two or more of these linkage groups.

If the weight average molecular weight of the macromonomer (M) is over $2\times10^4$, the copolymerizing property with the monomer represented by the general formula (V) is undesirably reduced. On the other hand, if the weight average molecular weight of the macromonomer is too small, the effect of improving the electrophotographic characteristics of the photoconductive layer is reduced. Thus, the weight average molecular weight is preferably from $1\times10^3$ to $2\times10^4$.

The macromonomer (M) for use in the present invention can be produced by known synthesis methods.

Specifically, the macromonomer can be synthesized by a radical polymerization method of forming the macromonomer by reacting an oligomer having a reactive group bonded to the terminal and various reagents. The oligomer used above can be obtained by a radical polymerization using a polymerization initiator and/or a chain transfer agent each having a reactive group such as a carboxy group, a carboxy halide group, a hydroxy group, an amino group, a halogen atom, or an epoxy group in the molecule thereof.

Specific methods for producing the macromonomer (M) are described, for example, in P. Dreyfuss & R. P. Quirk, *Encycl. Polym. Sci. Enq.*, 7, 551 (1987), P. F. Rempp & E. Franta, *Adu. Polym Sci.*, 58, 1 (1984), Yusuke Kawakami, *Kaqaku Koqvo (Chemical Industry)*, 38, 56 (1987), Yuya Yamashita, *Kobunshi (Macromolecule)*, 31, 988 (1982), Shiro Kobayashi, *Kobunshi (Macromolecule)*, 30, 625 (1981), Koichi Ito, *Kobunshi Kako (Macromolecular Processing)*, 35, 262 (1986), Kishiro Higashi & Takashi Tsuda, *Kino Zairyo (Functional Materials)*, 1987, No. 10, 5, and the literature references and patents cited in these references.

However, since the macromonomer (M) used in the present invention has the above described acidic group as the component of the repeating unit, the following matters should be considered in the synthesis thereof.

In one method, the radical polymerization and the introduction of a terminal reactive group are carried out by the above described method using a monomer having the acidic group as the form of a protected functional group as described, for example, in the following Reaction Scheme (I).

REACTION SCHEME (I)

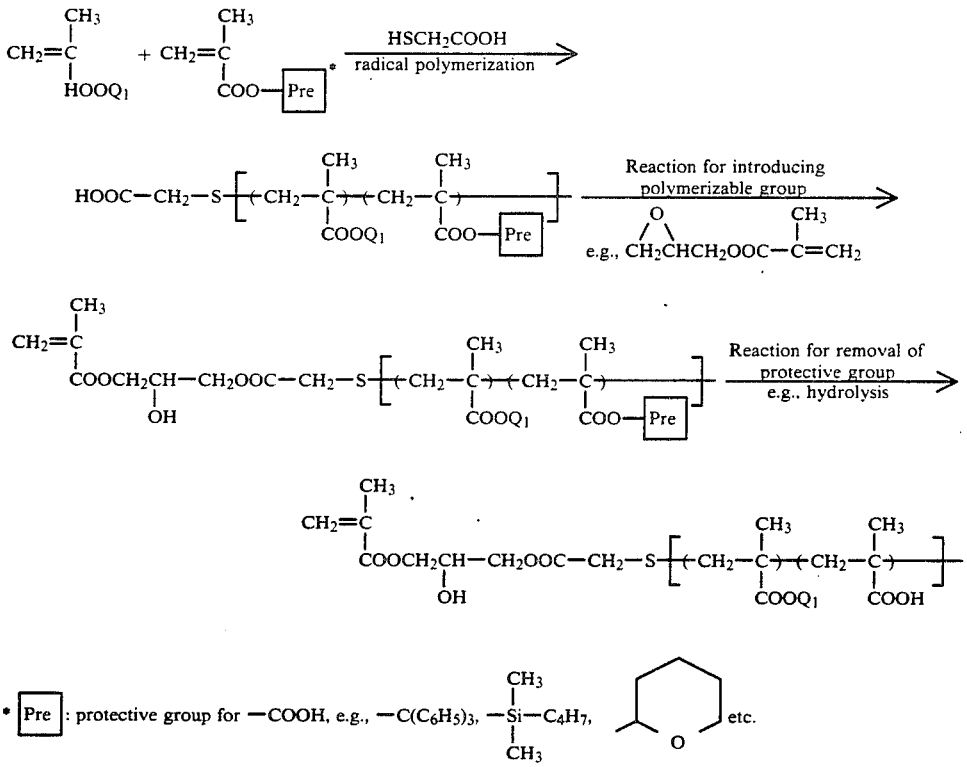

The reaction for introducing the protective group and the reaction for removal of the protective group (e.g., hydrolysis reaction, hydrogenolysis reaction, and oxidation-decomposition reaction) for the acidic group (—$SO_3H$, —$PO_3H_2$, —COOH,

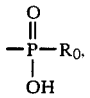

—OH, —CHO, and an acid anhydride, containing group) which is randomly contained in the macromonomer (M) for use in the present invention can be carried out by any of conventional methods.

The methods which can be used are specifically described, for example, in J. F. W. McOmie, *Protective Groups in Organic Chemistry*, Plenum Press (1973), T. W. Greene, *Protective Groups in Organic Synthesis*, John Wiley & Sons (1981), Ryoohei Oda, *Macromolecular Fine Chemical*, Kodansha K. K., (1976), Yoshio Iwakura and Keisuke Kurita, *Hannosei Kobunshi (Reactive Macromolecules)*, Kodansha K. K. (1977), G. Berner, et al, *J. Radiation Curing*, No. 10, p. 10(1986), JP A-62-212669, JP-A-62-286064, JP-A-62-210475, JP-A-62-195684, JP-A-62-258476, JP-A-63-260439, JP-A-01-63977 and JP-A-01-70767.

Another method for producing the macromonomer (M) comprises synthesizing the oligomer in the same manner as described above and then reacting the oligomer with a reagent having a polymerizable double bond group which reacts with only "specific reactive group" bonded to one terminal by utilizing the difference between the reactivity of the "specific reactive group" and the reactivity of the acidic group contained in the oligomer as shown in the following reaction scheme (II).

REACTION SCHEME (II)

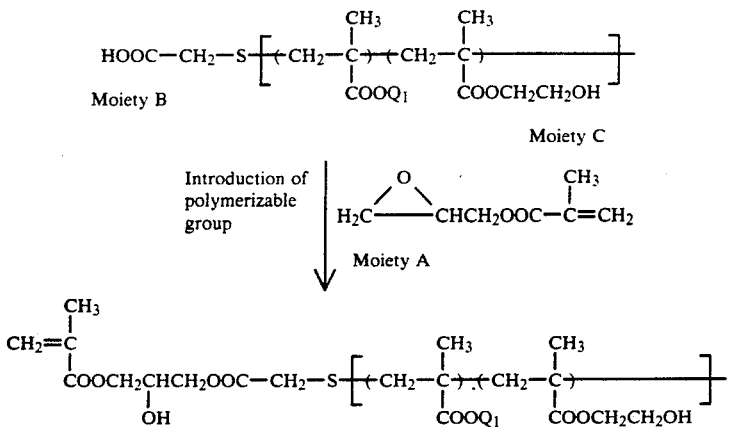

Specific examples of a combination of the specific functional groups (moieties A, B, and C) described, in the reaction scheme (II) are set forth in Table A below but the present invention should not be construed as being limited thereto. It is important to utilize the selectivity of reaction in an ordinary organic chemical reaction and the macromonomer may be formed without protecting the acidic group in the oligomer. In Table A, Moiety A is a functional group in the reagent for introducing a polymerizable group, Moiety B is a specific functional group at the terminal of oligomer, and Moiety C is an acidic group in the repeating unit in the oligomer.

TABLE A

| Moiety A | | Moiety B | | Moiety C | | |
|---|---|---|---|---|---|---|
| 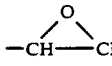 | 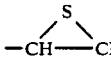 | —COOH, | —$NH_2$ | | —OH | |
| 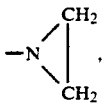 | —Halogen (Br, I, Cl) | | | | | |
| —COCl, —$SO_2Cl$, | Acid Anhydride | —OH, | —$NH_2$ | —COOH, 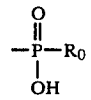 | —$SO_3H$, | —$PO_3H_2$, |
| —COOH, | —$NHR_{36}$ | | —Halogen | —COOH, —OH, | —$SO_3H$, 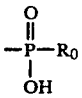 | —$PO_3H_2$, |
| —COOH, | —$NHR_{36}$ | 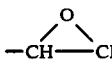 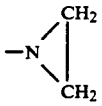 | 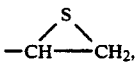 | | —OH | |
| —OH, | —$NHR_{36}$ | —COCl, | —$SO_2Cl$ | —COOH, | —$SO_3H$, | —$PO_3H_2$ |

(wherein $R_{36}$ is a hydrogen atom or an alkyl group)

The chain transfer agent which can be used for producing the oligomer includes, for example, mercapto compounds having a substituent capable of being introduced into the acidic group later (e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoylpropionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, and 2-mercapto-3-pyridinol), disulfide compounds which are the oxidation products of these mercapto compounds, and iodinated alkyl compounds having the above described acidic group or substituent (e.g., iodoacetic acid, iodopropionic acid, 2-iodoethanol, 2-iodoethanesulfonic acid, and 3-iodopropanesulfonic acid). In these compounds, the mercapto compounds are preferred.

Also, as the polymerization initiator having a specific reactive group, which can be used for the production of the oligomer, there are, for example, 2,2'-azobis(2-cyanopropanol), 2,2'-azobis(2-cyanopentanol), 4,4'-azobis(4-cyanovaleric acid), 4,4'-azobis(4-cyanovaleric acid chloride) 2 2'-azobis[2-(5-methyl-2-imidazolin-2-yl)propane], 2,2'-azobis[2-(2-imidazolin-2-yl)propane], 2,2'-azobis[2-(3,4,5,6-tetrahydropyrimidin-2-yl)propane], 2,2'-azobis{2-[1-(2-hydroxyethyl)-2-imidazolin-2-yl]propane, 2,2'-azobis[2-methyl-N-(2-hydroxyethyl)-propionamide] and the derivatives thereof.

The chain transfer agent or the polymerization initiator is used in an amount of from 0.1 to 15 parts by weight, and preferably from 0.5 to 10 parts by weight per 100 parts by weight of the total monomers.

Specific examples of the macromonomer (M) for use in the present invention are set forth below, but the present invention should not be construed as being limited thereto.

In the following formulae, $Q_2$ represents —H or —$CH_3$, $Q_3$ represents —H, —$CH_3$, or —$CH_2COOCH_3$, $R_{41}$ represents —$C_nH_{2n+1}$ (wherein n represents an integer of from 1 to 18), —$CH_2C_6H_5$,

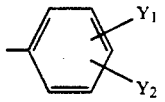

(wherein $Y_1$ and $Y_2$ each represents —H, —Cl, —Br, —$CH_3$, —$COCH_3$, or —$COOCH_3$)

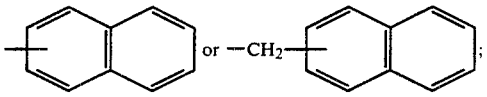

$W_1$ represents —CN, —$OCOCH_3$, —$CONH_2$, or —$C_6H_5$; $W_2$ represents —Cl, —Br, —CN, or —$OCH_3$; r represents an integer of from 2 to 18; s represents an integer of from 2 to 12; and t represents an integer of 2 to 4, (M-1)

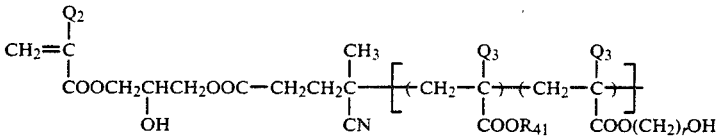

(M-2)

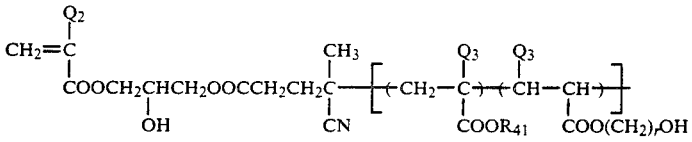

(M-3)

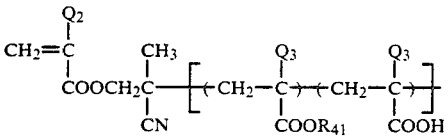

(M-4)

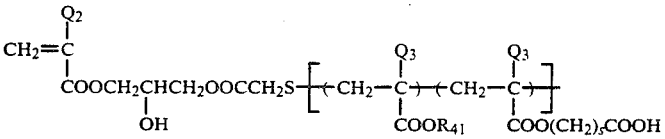

(M-5)

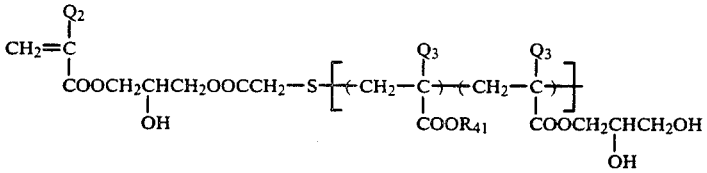

(M-6)

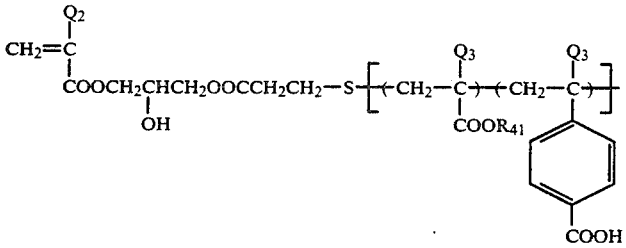

-continued
(M-7)
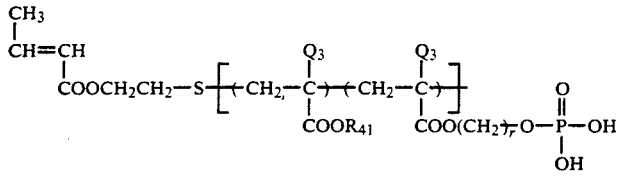
(M-8)
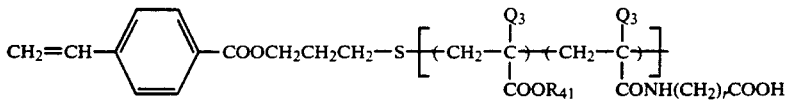
(M-9)
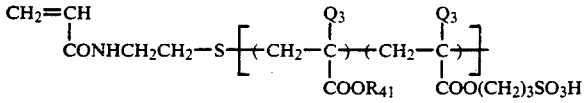
(M-10)
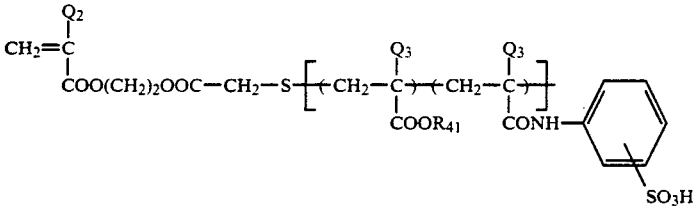
(M-11)
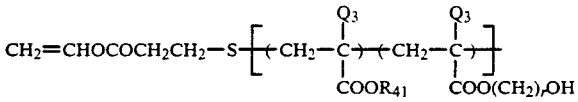
(M-12)
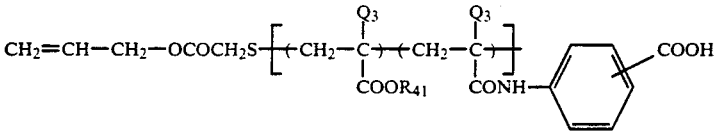
(M-13)
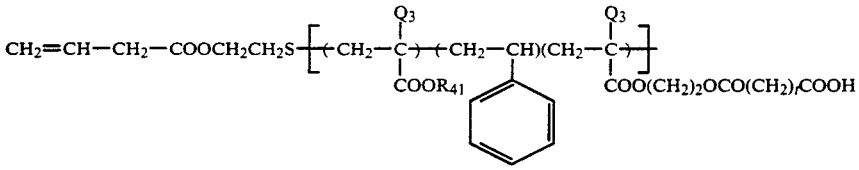
(M-14)
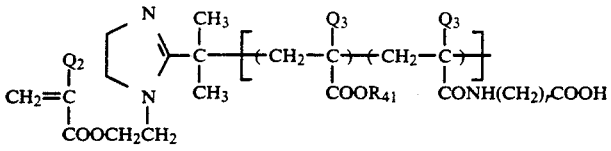
(M-15)
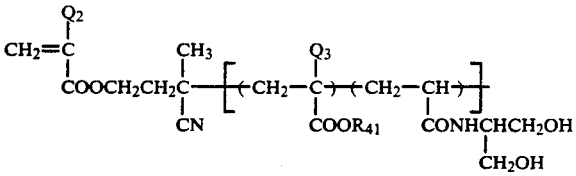
(M-16)
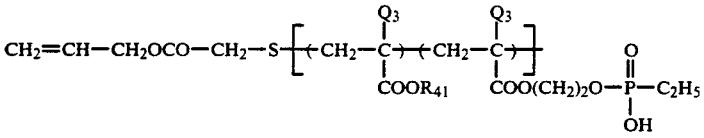

-continued
(M-17)
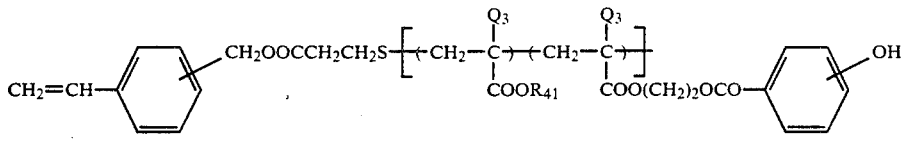
(M-18)
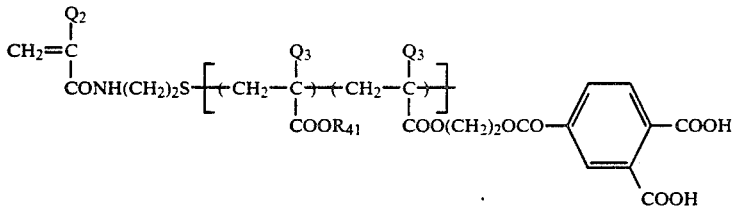
(M-19)
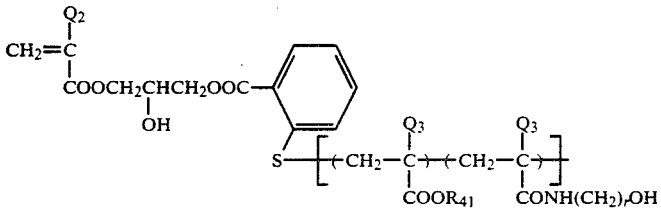
(M-20)
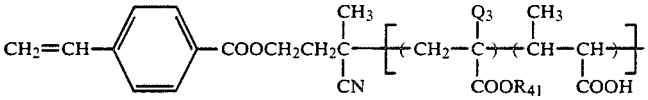
(M-21)
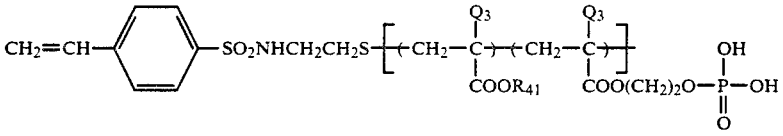
(M-22)
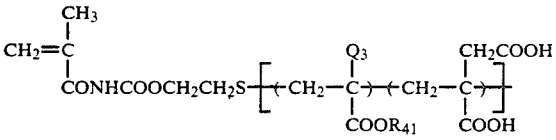
(M-23)
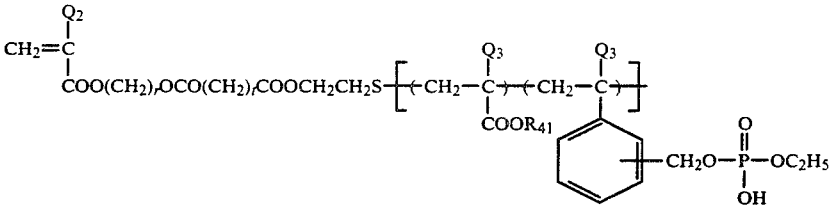
(M-24)
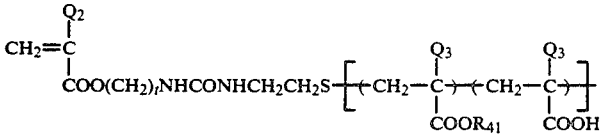
(M-25)
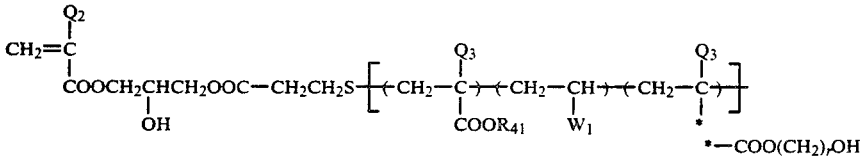

-continued (M-26)

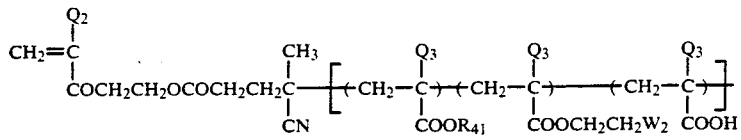

On the other hand, the monomer which is copolymerized with the above described macromonomer (M) is represented by the general formula (V) described above.

In the general formula (V), $e_1$ and $e_2$, which may be the same or different, have the same meaning as $c_1$ and $c_2$ in the general formula (III) and $X_2$ and $Q_2$ have the same meaning as $X_1$ and $Q_1$ in the general formula (IVa) and (IVb), respectively.

In the resin (B) for use in e s invention, the composition ratio of the copolymerizable component composed of the macromonomer (M) as the repeating unit and the copolymerizable component composed of the monomer represented by the general formula (V) as the repeating unit is preferably from 1 to 70/99 to 30 by weight ratio, and more preferably from 5 to 60/95 to 40 by weight ratio.

Further, the resin (B) may contain a component having as heat- and/or photocurable functional group same as that described in the resin (A) above as a copolymerizable component for the purpose of increasing mechanical strength.

Also, the resin (B) containing no copolymerizable component having the acidic group such as $-PO_3H_2$, $-SO_3H$, $-COOH$, $-OH$ and $-PO_3R_0H$ in the polymer main chain is preferred.

Furthermore, the resin (B) for use in the present invention may contain other monomers as additional copolymerizable components together with the macromonomer (M), the monomer represented by the general formula (V), and the optional monomer having the heat-and/or photocurable functional group.

Examples of such an additional monomer include α-olefins, alkanoic acid vinyl or allyl esters, acrylonitrile, methacrylonitrile, vinyl ethers, acrylamides, methacrylamides, styrenes, and heterocyclic vinyl compounds (e.g., vinylpyrrolidone, vinylpyridine, vinylimidazole, vinylthiophene, vinylimidazoline, vinylpyrazole, vinyldioxane, vinylquinoline, vinylthiazole, and vinyloxazine).

In this case, the content of the additional monomer should not exceed 20% by weight of the resin.

Furthermore, the resin (B) may be a copolymer (resin(B')) having at least one acidic group selected from those described above only at one terminal of the main chain of the polymer containing at least one repeating unit corresponding to the monomer represented by the general formula (V) and at least one repeating unit corresponding to the macromonomer (M). The resin (B) may be employed together with the resin (B'), if desired. The acidic group has a chemical structure which may be bonded to one terminal of the polymer main chain directly or via an appropriate linkage group.

The linkage group is composed of an appropriate combination of an atomic group such as a carbon-carbon bond (single bond or double bond), a carbon-hetero atom bond (examples of the hetero atom include oxygen, sulfur, nitrogen, and silicon), and a hetero atom-hetero atom bond, or an appropriate combination of these atomic groups.

Specific examples thereof are linkage groups composed of a single atomic group selected from

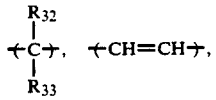

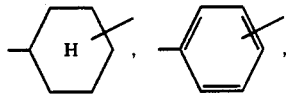

—O—, —S—,

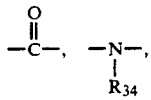

—COO—, $-SO_2$,

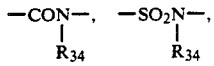

—NHCOO—, —NHCONH, and

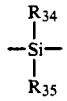

(wherein $R_{32}$, $R_{33}$, and $R_{34}$ are the same as defined above) and a linkage group composed of a combination of two or more atomic groups described above.

The resin (B') having the acidic group at the terminal of the polymer main chain thereof can be obtained by using a polymerization initiator or chain transfer agent having the acidic group or a specific reactive group which can be induced into the acidic group in the molecule in the polymerization reaction of at least the macromonomer (M) and the monomer represented by the general formula (V).

Specifically, the resin (B') can be synthesized in the same manner as the case of producing the oligomer having a reactive group bonded at one terminal as described above in the synthesis of the macromonomer (M).

In addition to the Resins (A) (including the Resin (A')) and (B) (including the Resin (B')), the resin binder according to the present invention may further comprise other resins. Suitable examples of such resins include alkyd resins, polybutyral resins, polyolefins, ethylene-vinyl acetate copolymers, styrene resins, ethylene-butadiene resins, acrylate-butadiene resins, and vinyl alkanoate resins.

The proportion of these other resins should not exceed 30% by weight based on the total weight of the binder. If the proportion exceeds 30% by weight, the effects of the present invention, particularly improvement of electrostatic characteristics, would be lost.

Where the Resin (A) and/or Resin (B) according to the present invention contain the heat-curable functional group described above, a reaction accelerator may be used, if desired, in order to accelerate a crosslinking reaction in the light-sensitive layer. Examples of reaction accelerators which can be employed in the reaction system for forming a chemical bond between functional groups include an organic acid (e.g., acetic acid, propionic acid, butyric acid, benzenesulfonic acid, and p-toluenesulfonic acid), and a crosslinking agent.

Specific examples of crosslinking agents are described, for example, in Shinzo Yamashita and Tosuke Kaneko (ed.), *KakVozai Handbook,* Taiseisha (1981), including commonly employed crosslinking agents, such as organosilanes, polyurethanes, and polyisocyanates, and curing agents, such as epoxy resins and melamine resins.

Where the crosslinking reaction is a polymerization reaction system, polymerization initiators (e.g., peroxides and azobis series polymerization initiators, and preferably azobis series polymerization initiators) and monomers having a polyfunction polymerizable group (e.g., vinyl methacrylate, allyl methacrylate, ethylene glycol diacrylate, polyethylene glycol diacrylate, divinylsuccinic acid esters, divinyladipic acid esters, and divinylbenzene) can be used as the reaction accelerator.

When the binder resin containing a heat-curable functional group is employed in the present invention, the photoconductive substance-binder resin dispersed system is subjected to heat-curing treatment. The heat-curing treatment can be carried out by drying the photoconductive coating under conditions more severe than those generally employed for the preparation of conventional photoconductive layer. For example, the heat-curing can be achieved by treating the coating at a temperature of from 60° C. to 120° C. for 5 to 120 minutes. In this case, the treatment can be performed under milder conditions using the above described reaction accelerator.

The ratio of the resin (A) (including the resin (A')) to the resin (B) (including the resin (B')) in the present invention varied depending on the kind, particle size, and surface conditions of the inorganic photoconductive substance used. In general, the weight ratio of the resin (A) to the resin (B) is 5 to 60 : 95 to 40, preferably 10 to 40 : 90 to 60.

The inorganic photoconductive substance which can be used in the present invention includes zinc oxide, titanium oxide, zinc sulfide, cadmium sulfide, cadmium carbonate, zinc selenide, cadmium selenide, tellurium selenide, and lead sulfide.

The resin binder is used in a total amount of from 10 to 100 parts by weight, preferably from 15 to 50 parts by weight, per 100 parts by weight of the inorganic photoconductive substance.

If desired, various dyes can be used as spectral sensitizers in the present invention. Examples of the spectral sensitizers are carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (including metallized dyes). Reference can be made to, for example, Harumi Miyamoto and Hidehiko Takei, *Imaging,* Vol. 1973, No. 8, p. 12, C. J. Young, et al., *RCA Review,* Vol. 15, p. 469 (1954), Kohei Kiyota, et al., *Denkitsushin Gakkai Ronbunshi,* Vol. J 63-C, No. 2, p. 97 (1980), Yuji Harasaki, et al., *Kogyo Kagaku Zasshi,* Vol. 66, pp. 78 and 188 (1963), and Tadaaki Tani, *Nihon Shashin Gakkaishi,* Vol. 35, p. 208 (1972).

Specific examples of the carbonium dyes, triphenylmethane dyes, xanthene dyes, and phthalein dyes are described, for example, in JP-B-51-452, JP-A-50-90334, JP-A-50-114227, JP-A-53-39130, JP A 53-82353, U.S. Pat. No. 3,052,540 and U.S. Pat. No. 4,054,450, and JP-A-57-16456.

Suitable polymethine dyes, such as oxonol dyes, merocyanine dyes, cyanine dyes, and rhodacyanine dyes, include those described in F. M. Hamer, *The Cyanine Dyes and Related Compounds.* Specific examples include those described, for example, in U.S. Pat. No. 3,047,384, U.S. Pat. No. 3,110,591, U.S. Pat. No. 3,121,008, U.S. Pat. No. 3,125,447, U.S. Pat. No. 3,128,179, U.S. Pat. No. 3,132,942, and U.S. Pat. No. 3,622,317, British Patents Nos. 1,226,892, 1,309,274 and 1,405,898, JP-B-48-7814 and JP-B-55-18892.

In addition, polymethine dyes capable of spectrally sensitizing in the longer wavelength region of 700 nm or more, i.e., from the near infrared region to the infrared region, include those described, for example, in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. No.3,619,154 and U.S. Pat. No. 4,175,956, and *Research Disclosure,* Vol. 216, pp. 117 to 118 (1982).

The light-sensitive material of the present invention is particularly excellent in that the performance properties do not tend to vary even when combined with various kinds of sensitizing dyes.

If desired, the photoconductive layer may further contain various additives commonly employed in conventional electrophotographic light-sensitive layer, such as chemical sensitizers. Examples of the additives include electron-accepting compounds (e.g., halogen, benzoquinone, chloranil, acid anhydrides, and organic carboxylic acids) as described in *Imaging,* Vol. 1973, No. 8, p. 12 supra; and polyarylalkane compounds, hindered phenol compounds, and p-phenylenediamine compounds as described in Hiroshi Kokado, et al., *Saikin-no Kododen Zairyo to Kankotai no Kaihatsu Jitsuyoka,* Chaps. 4 to 6, Nippon Kagaku Joho K. K. (1986).

The amount of these additives is not particularly restricted and usually ranges from 0.0001 to 2.0 parts by weight per 100 parts by weight of the photoconductive substance.

The photoconductive layer of the light-sensitive material suitably has a thickness of from 1 to 100 μm, particularly from 10 to 50 μm.

Where the photoconductive layer functions as a charge generating layer in a laminated light-sensitive material comprising a charge generating layer and a charge transporting layer, the thickness of the charge generating layer suitably ranges from 0.01 to 1 μm, particularly from 0.05 to 0.5 μm.

If desired, an insulating layer can be provided on the light-sensitive layer of the present invention. When the insulating layer is made to serve for the main purposes for protection and improvement of durability and dark decay characteristics of the light-sensitive material, its thickness is relatively small. When the insulating layer is formed to provide the light-sensitive material suitable for application to special electrophotographic processes, its thickness is relatively large, usually ranging from 5 to 70 μm, particularly from 10 to 50 μm.

Charge transporting materials useful in the above-described laminated light sensitive material include polyvinylcarbazole, oxazole dyes, pyrazoline dyes, and triphenylmethane dyes. The thickness of the charge transporting layer ranges from 5 to 40 μm, preferably from 10 to 30 μm.

Resins which can be used in the insulating layer or charge transporting layer typically include thermoplastic and thermosetting resins, e.g., polystyrene resins, polyester resins, cellulose resins, polyether resins, vinyl chloride resins, vinyl acetate resins, vinyl chloride-vinyl acetate copolymer resins, polyacrylate resins, polyolefin resins, urethane resins, epoxy resins, melamine resins, and silicone resins.

The photoconductive layer according to the present invention can be provided on any known support. In general, a support for an electrophotographic light-sensitive layer is preferably electrically conductive. Any of conventionally employed conductive supports may be utilized in the present invention. Examples of usable conductive supports include a substrate (e.g., a metal sheet, paper, and a plastic sheet) having been rendered electrically conductive by, for example, impregnating with a low resistant substance; the above-described substrate with the back side thereof (opposite to the light-sensitive layer side) being rendered conductive and having further coated thereon at least one layer for the purpose of prevention of curling; the above-described substrate having provided thereon a water-resistant adhesive layer; the above-described substrate having provided thereon at least one precoat layer; and paper laminated with a conductive plastic film on which aluminum, etc. is deposited.

Specific examples of conductive supports and materials for imparting conductivity are described, for example, in Yoshio Sakamoto, *Denshishashin,* Vol. 14, No. 1, pp. 2 to 11 (1975), Hiroyuki Moriga, *Nyumon Tokushushi no Kaqaku,* Kobunshi Kankokai (1975), and M. F. Hoover, *J. Macromol. Sci. Chem.,* A-4(6), pp. 1327 to 1417 (1970).

In accordance with the present invention, an electrophotographic light-sensitive material which exhibits excellent electrostatic characteristics and mechanical strength even under severe conditions. The electrophotographic light sensitive material according to the present invention is also advantageously employed in the scanning exposure system using a semiconductor laser beam.

The present invention will now be illustrated in greater detail with reference to the following examples, but it should be understood that the present invention is not to be construed as being limited thereto.

SYNTHESIS EXAMPLE A-1

Synthesis of Resin (A-1)

A mixed solution of 96 g of benzyl methacrylate, 4 g of thiosalicylic acid, and 200 g of toluene was heated to 75° C. in a nitrogen stream, and 1.0 g of 2,2'-azobisisobutyronitrile (hereinafter abbreviated as AIBN) was added thereto to effect reaction for 4 hours. To the reaction mixture was further added 0.4 g of AIBN, followed by reacting for 2 hours, and thereafter 0.2 g of AIBN was added thereto, followed by reacting for 3 hours with stirring. The resulting copolymer (A-1) had a weight average molecular weight (hereinafter simply referred to as Mw) of $6.8\times10^3$.

(A-1):

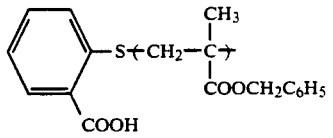

SYNTHESIS EXAMPLES A-2 TO A 13

Synthesis of Resins (A-2) to (A 13)

Resins (A) shown in Table 1 below were synthesized in the same manner as described in Synthesis Example A-1, except for using the monomers described in Table 1 below in place of 96 g of benzyl methacrylate, respectively. These resins had an Mw of from $6.0\times10^3$ to $8.0\times10^3$.

TABLE 1

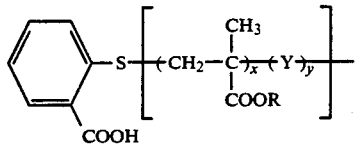

| Synthesis Example No. | Resin (A) | R | —Y— | x/y (weight ratio) |
|---|---|---|---|---|
| A-2 | (A-2) | $-C_2H_5$ | — | 96/0 |
| A-3 | (A-3) | $-C_6H_5$ | — | 96/0 |
| A-4 | (A-4) | 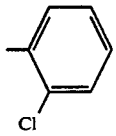 | — | 96/0 |

TABLE 1-continued

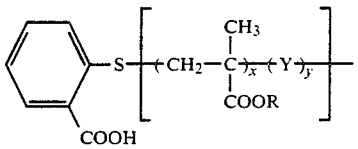

| Synthesis Example No. | Resin (A) | R | —Y— | x/y (weight ratio) |
|---|---|---|---|---|
| A-5 | (A-5) | 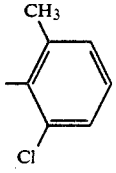 | — | 96/0 |
| A-6 | (A-6) | $-CH_3$ | $-CH_2-\underset{\underset{COOCH_3}{\vert}}{CH}-$ | 86/10 |
| A-7 | (A-7) | $-C_2H_5$ | $-CH_2-\underset{\underset{\bigcirc}{\vert}}{CH}-$ | 86/10 |
| A-8 | (A-8) | 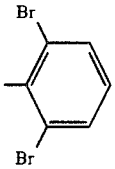 | $-CH_2-\overset{\overset{CH_3}{\vert}}{\underset{\underset{COOC_2H_5}{\vert}}{C}}-$ | 66/30 |
| A-9 | (A-9) | 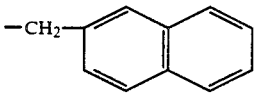 | — | 96/0 |
| A-10 | (A-10) | 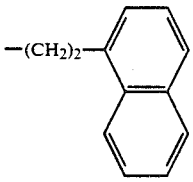 | — | 96/0 |
| A-11 | (A-11) | 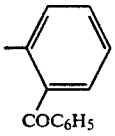 | — | 96/0 |
| A-12 | (A-12) | 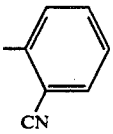 | $-CH_2-\overset{\overset{CH_3}{\vert}}{\underset{\underset{COOC_2H_5}{\vert}}{C}}-$ | 76/20 |
| A-13 | (A-13) | $-CH_2CH_2OC_6H_5$ | — | 96/0 |

SYNTHESIS EXAMPLES A-14 TO A-24

Synthesis of Resins (A-14) to (A-24)

Resins (A) shown in Table 2 below were synthesized under the same reaction conditions as described in Synthesis Example A-1, except for using the methacrylates and mercapto compounds described in Table 2 below in place of 96 g of benzyl methacrylate and 4 g of thiosalicylic acid and replacing 200 g of toluene with 150 g of toluene and 50 g of isopropanol, respectively.

TABLE 2

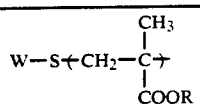

| Synthesis Example No. | Resin (A) | Mercapto Compound (W—) | | —R | | Weight Average Molecular Weight |
|---|---|---|---|---|---|---|
| A-14 | (A-14) | $HOOCCH_2CH_2CH_2$— | 4 g | —$C_2H_5$ | 96 g | $7.3 \times 10^3$ |
| A-15 | (A-15) | $HOOCCH_2$— | 5 g | —$C_3H_7$ | 95 g | $5.8 \times 10^3$ |
| A-16 | (A-16) | HOOC—CH—<br>\|<br>HOOC—$CH_2$— | 5 g | —$CH_2C_6H_5$ | 95 g | $7.5 \times 10^3$ |
| A-17 | (A-17) | $HOOCCH_2CH_2$— | 5.5 g | —$C_6H_5$ | 94.5 g | $6.5 \times 10^3$ |
| A-18 | (A-18) | $HOOCCH_2$— | 4 g | 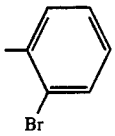 | 96 g | $5.3 \times 10^3$ |
| A-19 | (A-19) | O<br>‖<br>HO—P—$OCH_2CH_2$—<br>\|<br>OH | 3 g | 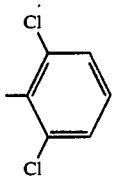 | 97 g | $6.0 \times 10^3$ |
| A-20 | (A-20) | $HO_3SCH_2CH_2$— | 3 g | 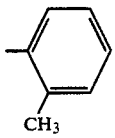 | 97 g | $8.8 \times 10^3$ |
| A-21 | (A-21) | O<br>‖<br>$H_5C_2O$—P—$OCH_2CH_2$—<br>\|<br>OH | 4 g | 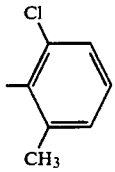 | 96 g | $7.5 \times 10^3$ |
| A-22 | (A-22) | 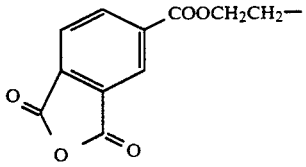 | 7 g | 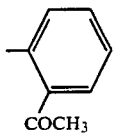 | 93 g | $5.5 \times 10^3$ |
| A-23 | (A-23) | O<br>‖<br>$H_5C_2$—P—$OCH_2CH_2$—<br>\|<br>OH | 6 g | 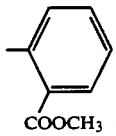 | 94 g | $4.5 \times 10^3$ |
| A-24 | (A-24) | 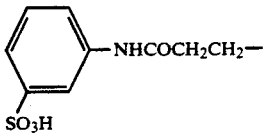 | 4 g | 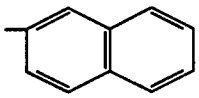 | 96 g | $5.6 \times 10^3$ |

SYNTHESIS EXAMPLE A-25

Synthesis of Resin (A-25)

A mixed solution of 100 g of 1-naphthyl methacrylate, 150 g of toluene and 50 g of isopropanol was heated to 80° C. in a nitrogen stream, and 5.0 g of 4,4'-azobis(4-cyanovaleric acid) (hereinafter abbreviated as "ACV") was added thereto, followed by reacting with stirring for 5 hours. Then, 1 g of ACV was added thereto, followed by reacting with stirring for 2 hours, and thereafter 1 g of ACV was added thereto, followed by reacting with stirring for 3 hours. The resulting copolymer (A-25) had a weight average molecular weight of $7.5\times10^3$.

(A-25): 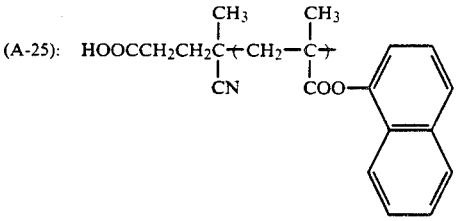

SYNTHESIS EXAMPLE A-26

Synthesis of Resin (A-26)

A mixed solution of 50 g of methyl methacrylate and 150 g of methylene chloride was cooled to −20° C. in a nitrogen stream, and 5 g of a 10% hexane solution of 1,1-diphenylhexyl lithium prepared just before was added thereto, followed by stirring for 5 hours. Carbon dioxide was passed through the mixture at a flowing rate of 10 ml/cc for 10 minutes with stirring, the cooling was stopped and the reaction mixture was allowed to cool to room temperature with stirring. Then, the reaction mixture was added to a solution of 50 ml of 1N hydrochloric acid in 1 liter of methanol to precipitate, and the white powder was collected by filtration. The powder was washed with water until the washings became neutral, and dried under reduced pressure to obtain 18 g of the copolymer having a weight average molecular weight of $6.5\times10^3$.

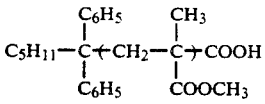

(A-26)

SYNTHESIS EXAMPLE A-27

Synthesis of Resin (A-27)

A mixed solution of 95 g of n-butyl methacrylate, 4 g of thioglycolic acid, and 200 g of toluene was heated to 75° C. in a nitrogen stream, and 1.0 g of ACV was added thereto to effect reaction for 6 hours. Then, 0.4 g of AIBN was added thereto, followed by reacting for 3 hours. The resulting copolymer had a weight average molecular weight of $7.8\times10^3$.

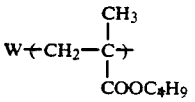

(A-27)

-continued

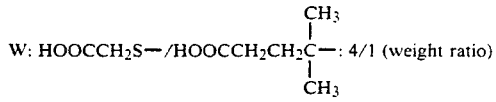

W: HOOCCH$_2$S—/HOOCCH$_2$CH$_2$C—: 4/1 (weight ratio)

SYNTHESIS EXAMPLE M-1

Synthesis of Macromonomer (MM-1)

A mixed solution of 90 g of ethyl methacrylate, 10 g of 2-hydroxyethyl methacrylate, 5 g of thioglycolic acid and 200 g of toluene was heated to 75° C. with stirring in a nitrogen stream and, after adding thereto 1.0 g of 2,2-azobisisobutyronitrile (AIBN), the reaction was carried out for 8 hours. Then, to the reaction mixture were added 8 g of glycidyl methacrylate, 1.0 g of N,N-dimethyldodecylamine and 0.5 g of tert-butylhydroquninone, and the resulting mixture was stirred for 12 hours at 100° C. After cooling, the reaction mixture was reprecipitated from 2 liters of n-hexane to obtain 82 g of the desired macromonomer (MM-1) as a white powder. The weight average molecular weight of the macromonomer obtained was $3.8\times10^3$.

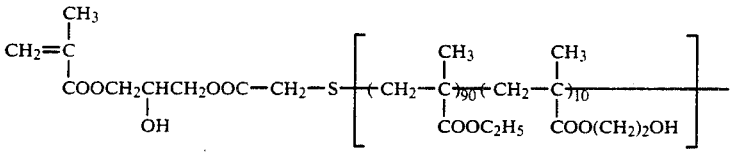

(MM-1)

SYNTHESIS EXAMPLE M-2

Synthesis of Macromonomer (MM-2)

A mixed solution of 90 g of butyl methacrylate, 10 g of methacrylic acid, 4 g of 2-mercaptoethanol, and 200 g of tetrahydrofuran was heated to 70° C. in a nitrogen stream and, after adding thereto 1.2 g of AIBN, the reaction was carried out for 8 hours.

Then, after cooling the reaction mixture in a water bath to 20° C., 10.2 g of triethylamine was added to the reaction mixture, and then 14.5 g of methacrylic acid chloride was added dropwise to the mixture with stirring at a temperature below 25° C. Thereafter, the resulting mixture was further stirred for one hour. Then, after adding thereto 0.5 g of tert-butylhydroquinone, the mixture was heated to 60° C. and stirred for 4 hours. After cooling, the reaction mixture was added dropwise to one liter of water with stirring over a period of about 10 minutes, and the mixture was stirred for one hour. Then, the mixture was allowed to stand and water was removed by decantation. The mixture was washed twice with water and, after dissolving it in 100 ml of tetrahydrofuran, the solution was reprecipitated from 2 liter of petroleum ether. The precipitates thus formed were collected by decantation and dried under reduced pressure to obtain 65 g of the desired macromonomer as a viscous product. The weight average molecular weight of the product was $5.6\times10^3$.

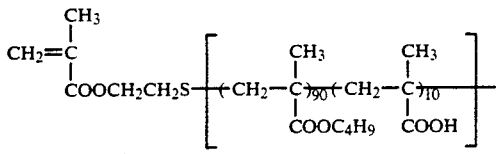

(MM-2)

SYNTHESIS EXAMPLE M-3

Synthesis of Macromonomer (MM-3)

A mixed solution of 95 g of benzyl methacrylate, 5 g of 2-phosphonoethyl methacrylate, 4 g of 2-aminoethylmercaptan, and 200 g of tetrahydrofuran was heated to 70° C. with stirring in a nitrogen stream.

Then, after adding 1.5 g of AIBN to the reaction mixture, the reaction was carried out for 4 hours and, after further adding thereto 0.5 g of AIBN, the reaction was carried out for 4 hours. Then, the reaction mixture was cooled to 20° C. and, after adding thereto 10 g of acrylic acid anhydride, the mixture was stirred for one hour at a temperature of from 20° C. to 25° C. Then, 1.0 g of tert-butylhydroquinone was added to the reaction mixture, and the resulting mixture was stirred for 4 hours at a temperature of from 50° C. to 60° C. After cooling, the reaction mixture was added dropwise to one liter of water with stirring over a period of about 10 minutes followed by stirring for one hour. The mixture was allowed to stand, and water was removed by decantation. The product was washed twice with water, dissolved in 100 ml of tetrahydrofuran and the solution was reprecipitated from 2 liters of petroleum ether. The precipitates formed were collected by decantation and dried under reduced pressure to obtain 70 g of the desired macromonomer as a viscous product. The weight average molecular weight was $7.4\times10^3$.

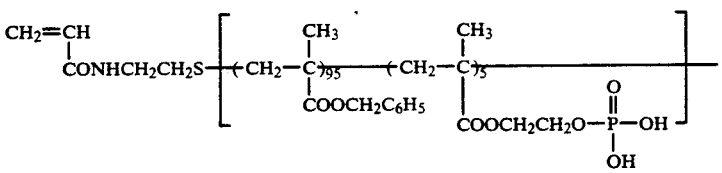

(MM-3)

SYNTHESIS EXAMPLE M-4

Synthesis of Macromonomer (MM-4)

A mixed solution of 95 g of 2-chlorophenyl methacrylate, 5 g of Monomer (I) having the structure shown below, 4 g of thioglycolic acid and 200 g of toluene was heated to 70° C. in a nitrogen stream.

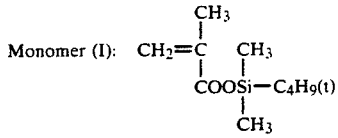

Then, 1.5 g of AIBN was added to the reaction mixture, and the reaction was carried out for 5 hours. After further adding thereto 0.5 g of AIBN, the reaction was carried out for 4 hours. Then, after adding thereto 12.4 g of glycidyl methacrylate, 1.0 g of N,N-dimethyldodecylamine, and 1.5 g of tert-butylhydroquinone, the reaction was carried out for 8 hours at 110° C. After cooling, the reaction mixture was added to a mixture of 3 g of p-toluenesulfonic acid and 100 ml of an aqueous solution of 90% by volume tetrahydrofuran, and the mixture was stirred for one hour at a temperature of from 30° C. to 35° C. The reaction mixture obtained was reprecipitated from 2 liters of a mixture of water and ethanol ($\frac{1}{3}$ by volume ratio), and the precipitates thus formed were collected by decantation and dissolved in 200 ml of tetrahydrofuran. The solution was reprecipitated from 2 liters of n-hexane to obtain 58 g of the desired macromonomer (MM-4) as powder. The weight average molecular weight thereof was $7.6\times10^3$.

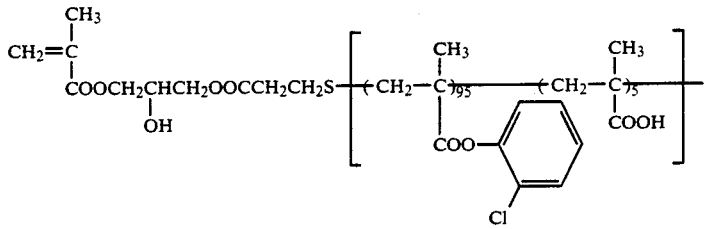

SYNTHESIS EXAMPLE M-5

Synthesis of Macromonomer (MM-5)

A mixed solution of 95 g of 2,6-dichlorophenyl methacrylate, 5 g of 3-(2'-nitrobenzyloxysulfonyl)propyl methacrylate, 150 g of toluene and 50 g of isopropyl alcohol was heated to 80° C. in a nitrogen stream. Then, after adding 5.0 g of 2,2'-azobis(2-cyanovaleric acid) (hereinafter abbreviated as ACV) to the reaction mixture, the reaction was carried out for 5 hours and, after further adding thereto 1.0 g of ACV, the reaction was carried out for 4 hours. After cooling, the reaction mixture was reprecipitated from 2 liters of methanol and the powder thus formed was collected and dried under reduced pressure.

A mixture of 50 g of the powder obtained in the above step, 14 g of glycidyl methacrylate, 0.6 g of N,N,-dimethyldodecylamine, 1.0 g of tert-butylhydroquinone, and 100 g of toluene was stirred for 10 hours at 110° C. After cooling to room temperature, the reaction mixture was irradiated with a high pressure mercury lamp of 80 watts with stirring for one hour. Thereafter, the reaction mixture was reprecipitated from one liter of methanol, and the powder formed was collected by filtration and dried under reduced pressure to obtain 34 g of the desired macromonomer (MM-5). The weight average molecular weight of the product was $7.3\times10^3$.

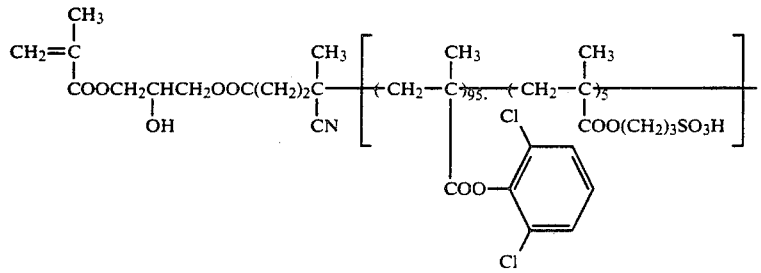

(MM-5)

SYNTHESIS EXAMPLE B-1

Synthesis of Resin (B-1)

A mixed solution of 80 g of benzyl methacrylate, 20 g of Macromonomer (MM-2) obtained in Synthesis Example M-2, and 100 g of toluene was heated to 75° C. in a nitrogen stream. After adding 0.8 g of 1,1'-azobis(cyclohexane-1-carbocyanide) (hereinafter abbreviated as ABCC) to the reaction mixture, the reaction was carried out for 4 hours and, after further adding thereto 0.5 g of AIBN, the reaction was carried out for 3 hours to obtain the desired resin (B-1). The weight average molecular weight of the copolymer was $1.0\times10^5$.

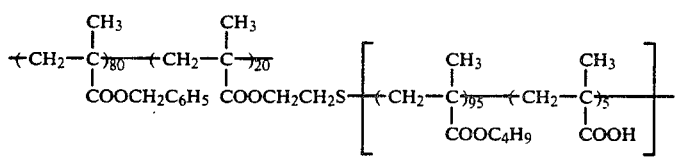

(B-1)

SYNTHESIS EXAMPLE B-2

Synthesis of Resin (B-2)

A mixed solution of 70 g of 2-chlorophenyl methacrylate, 30 g of Macromonomer (MM-1) obtained in Synthesis Example M-1, 0.7 g of thioglycolic acid, and 150 g of toluene was heated to 80° C. in a nitrogen stream and, after adding thereto 0.5 g of ABCC, the reaction was carried out for 5 hours. Then, 0.3 g of ABCC was added to the reaction mixture, and the reaction was carried out for 3 hours and after further adding 0.2 g of ABCC, the reaction was further carried out for 3 hours to obtain the desired resin (B-2). The weight average molecular weight of the copolymer was $9.2\times10^4$.

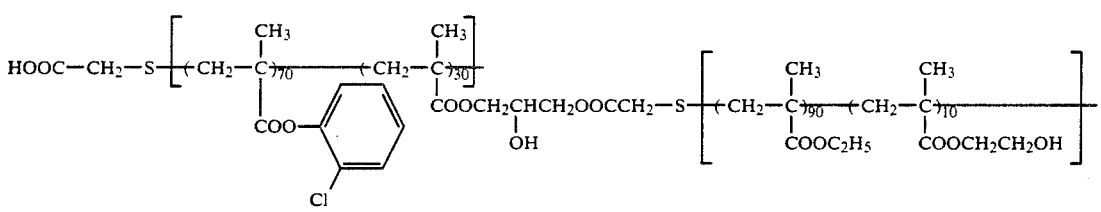

(B-2)

SYNTHESIS EXAMPLE B-3

Synthesis of Resin (B-3)

A mixed solution of 60 g of ethyl methacrylate, 25 g of Macromonomer (MM-4) obtained in Synthesis Example M-4, 15 g of methyl acrylate, and 150 g of toluene was heated to 75° C. in a nitrogen stream. Then, 0.5 of ACV was added to the reaction mixture, and the reaction was carried out for 5 hours and, after further adding thereto 0.3 g of ACV, the reaction was carried out for 4 hours to obtain the desired resin (B-3). The weight average molecular weight of the copolymer was $1.1\times10^5$.

(B-3)

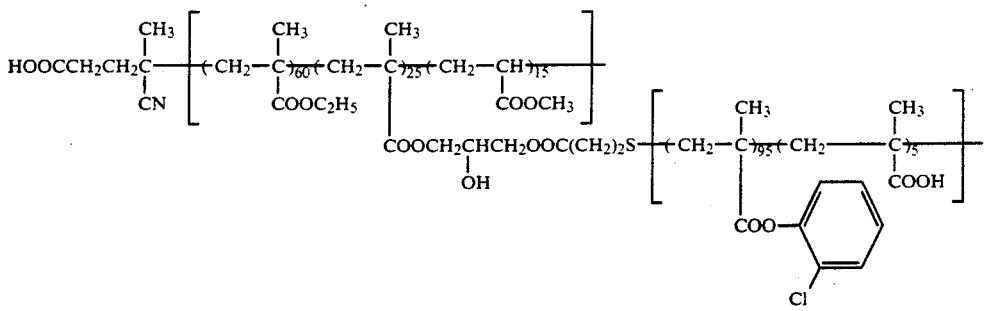

SYNTHESIS EXAMPLES B-4 TO B-11

Synthesis of Resins (B-4) to (B-11)

Resins (B) shown in Table 3 below were synthesized in the same manner as described in Synthesis Example B-1 except for using the corresponding methacrylates and macromonomers shown in Table 3 below, respectively. The weight average molecular weight of each resin was in a range of from $9.5\times10^4$ to $1.2\times10^5$.

TABLE 3

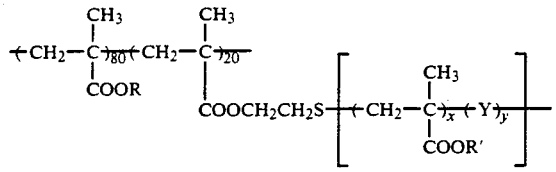

| Synthesis Example No. | Resin (B) | R | R' | x/y (weight ratio) | —Y— |
|---|---|---|---|---|---|
| B-4 | (B-4) | $-C_2H_5$ | 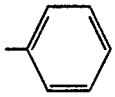 | 95/5 | $-CH_2-CH(COOH)-$ |
| B-5 | (B-5) | $-C_3H_7$ | 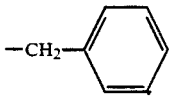 | 93/7 | $-CH_2-C(CH_3)(COO(CH_2)_2OCO(CH_2)_3COOH)-$ |
| B-6 | (B-6) | $-C_4H_9$ | 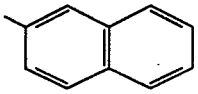 | 96/4 | $-CH_2-C(CH_3)(COO(CH_2)_2O-P(=O)(OH)-OH)-$ |
| B-7 | (B-7) | 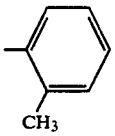 | $-CH_3$ | 95/5 | $-CH_2-CH(COOCH_2CH_2COOH)-$ |
| B-8 | (B-8) | 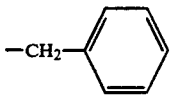 | $-C_2H_5$ | 94/6 | 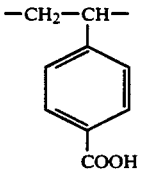 |
| B-9 | (B-9) | 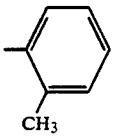 | $-C_4H_9$ | 96/4 | $-CH_2-C(CH_3)(COO(CH_2)_3SO_3H)-$ |

TABLE 3-continued

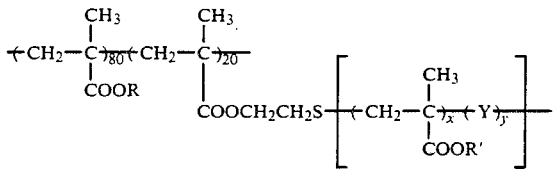

| Synthesis Example No. | Resin (B) | R | R' | x/y (weight ratio) | —Y— |
|---|---|---|---|---|---|
| B-10 | (B-10) | $-CH_3$ | 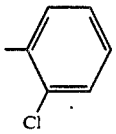 | 96/4 | 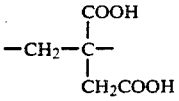 |
| B-11 | (B-11) | $-CH_3$ | $-C_2H_5$ | 92/8 | 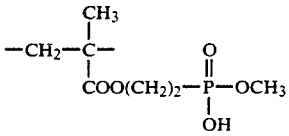 |

SYNTHESIS EXAMPLES B-12 TO B-19

Synthesis of Resins (B-12) to (B-19)

Resins (B) shown in Table 4 below were synthesized in the same manner as described in Synthesis Example B-2, except for using the methacrylates, macromonomers and mercapto compounds as shown in Table 4 below, respectively. The weight average molecular weight of each resin was in a range of from $9\times10^4$ to $1.1\times10^5$.

TABLE 4

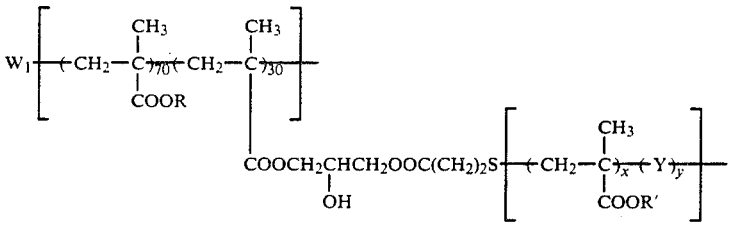

| Synthesis Example No. | Resin (B) | $W_1$— | R | R' | x/y (weight ratio) | —Y— |
|---|---|---|---|---|---|---|
| B-12 | (B-12) | $HOOC-H_2C-S-$ | 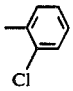 | $-C_2H_5$ | 90/10 | 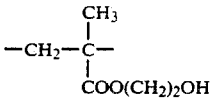 |
| B-13 | (B-13) | 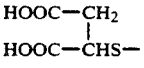 | 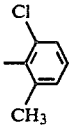 | 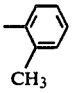 | 85/15 | 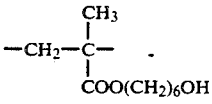 |
| B-14 | (B-14) | 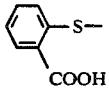 | 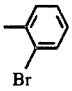 | 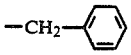 | 90/10 | 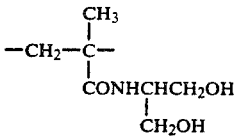 |
| B-15 | (B-15) | 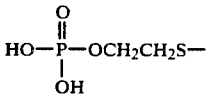 | $-C_2H_5$ | 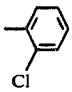 | 92/8 | 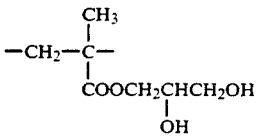 |

TABLE 4-continued

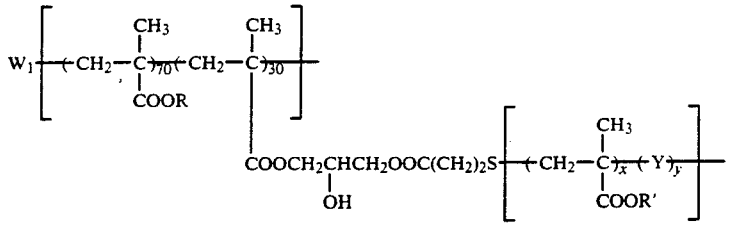

| Synthesis Example No. | Resin (B) | $W_1$— | R | R' | x/y (weight ratio) | —Y— |
|---|---|---|---|---|---|---|
| B-16 | (B-16) | $HO_3SCH_2CH_2S$— | 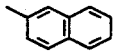 | —$C_4H_9$ | 93/7 | 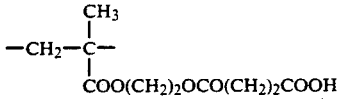 |
| B-17 | (B-17) | $HOCH_2CH_2$—S— | 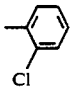 | —$C_2H_5$ | 92/8 | 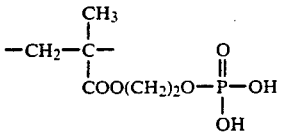 |
| B-18 | (B-18) | HOOC—$(CH_2)_2$S— | 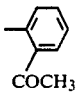 | —$C_3H_7$ | 95/5 | 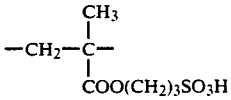 |
| B-19 | (B-19) | 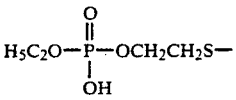 | 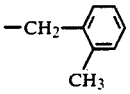 | 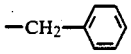 | 80/20 | 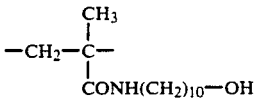 |

SYNTHESIS EXAMPLES B-20 TO B-27

Synthesis of Resins (B-20) to (B-27)

Resins (B) shown in Table 5 below were synthesized in the same manner as described in Synthesis Example B-3, except for using the methacrylates, macromonomers and azobis compounds as shown in Table 5 below, respectively. The weight average molecular weight of each resin was in a range of from $9.5\times104$ to $1.5\times10^5$.

TABLE 5
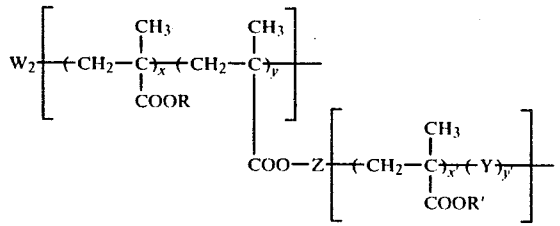
| Synthesis Example No. | (B) | $W_2$— | R | (Weight ratio) x/y | —Z— | R' | —Y— | (Weight ratio) x'/y' |
|---|---|---|---|---|---|---|---|---|
| B-20 | (B-20) | 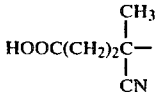 | $-C_2H_5$ | 70/30 | 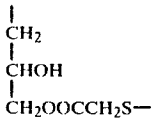 | 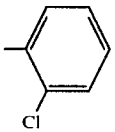 | 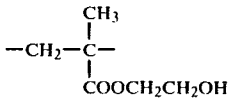 | 90/10 |
| B-21 | (B-21) | " | $-C_3H_7$ | 75/25 | " | $-CH_2C_6H_5$ | 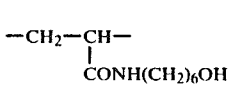 | 85/15 |
| B-22 | (B-22) | 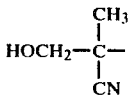 | $-C_2H_5$ | 90/10 | $-(CH_2)_2OOC(CH_2)_2S-$ | 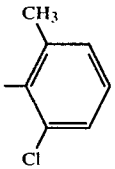 | 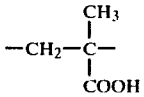 | 90/10 |
| B-23 | (B-23) | 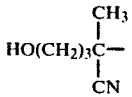 | $-CH_2C_6H_5$ | 85/15 | $-(CH_2)_2S-$ | $-C_2H_5$ |  | 92/8 |
| B-24 | (B-24) | 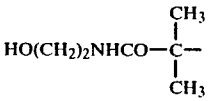 | 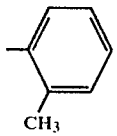 | 88/12 | $-(CH_2)_2S-$ | $-C_4H_9$ | 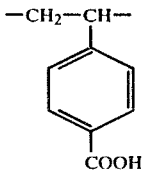 | 90/10 |

TABLE 5-continued
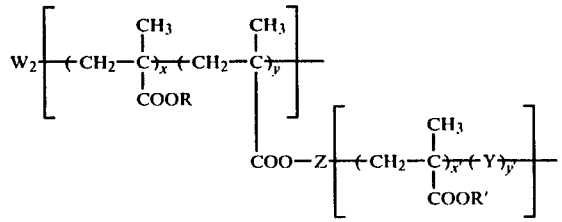
| Synthesis Example No. | (B) | $W_2$— | R | (Weight ratio) x/y | —Z— | R' | —Y— | (Weight ratio) x'/y' |
|---|---|---|---|---|---|---|---|---|
| B-25 | (B-25) | 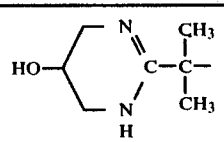 | $-C_2H_5$ | 85/15 | " | 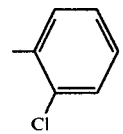 | 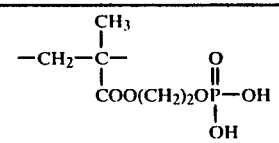 | 95/5 |
| B-26 | (B-26) | 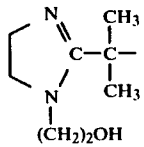 | $-C_3H_7$ | 80/20 | 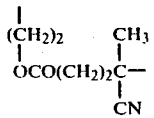 | 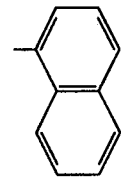 | 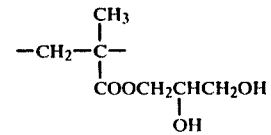 | 90/10 |
| B-27 | (B-27) | 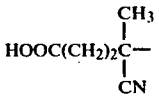 | $-CH_2C_6H_5$ | 85/15 | 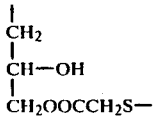 | 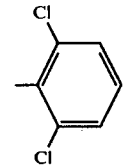 | 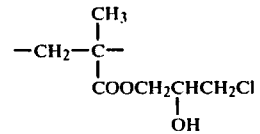 | 90/10 |

EXAMPLE 1

A mixture of 6 g (solid basis, hereinafter the same) of Resin (A-1), 34 g (solid basis, hereinafter the same) of Resin (B-1), 200 g of zinc oxide, 0.018 g of Cyanine Dye (I) shown below, 0.10 g of phthalic anhydride, and 300 g of toluene was dispersed in a ball mill for 2 hours to prepare a coating composition for a light-sensitive layer. The coating composition was coated on paper subjected to electrically conductive treatment, with a wire bar to a dry coverage of 20 g/m$^2$, followed by drying at 110° C. for 30 seconds. The coated material was allowed to stand in a dark place at 20° C. and 65% RH (relative humidity) for 24 hours to prepare an electrophotographic light-sensitive material.

Cyanine Dye (I):

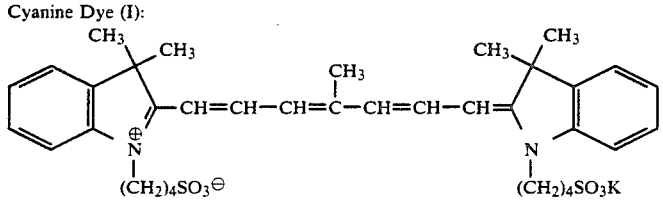

EXAMPLE 2

An electrophotographic light sensitive material was produced in the same manner as described in Example 1, except for using 6 g of Resin (A-4) in place of 6 g of Resin (A-1).

COMPARATIVE EXAMPLE A

An electrophotographic light-sensitive material was produced in the same manner as described in Example 1, except for using 40 g of Resin (P-1) having the structure shown below in place of 6 g of Resin (A-1) and 34 g of Resin (B-1).

Resin (P-1):

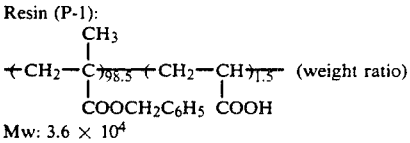

Mw: 3.6 × 10$^4$

COMPARATIVE EXAMPLE B

An electrophotographic light-sensitive material was prepared in the same manner as described in Example 1, except for using 34 g of poly(ethyl methacrylate) (Resin (P-3)) having an Mw of 2.4×10$^5$ in place of 34 g of Resin (B-1).

Each of the light-sensitive materials obtained in Examples 1 and 2 and Comparative Examples A and B was evaluated for film properties in terms of surface smoothness and mechanical strength; electrostatic characteristics; image forming performance; image forming performance under environmental conditions of 30° C. and 80% RH; oil-desensitivity when used as an offset master plate precursor (expressed in terms of contact angle of the layer with water after oil-desensitization treatment); and printing suitability (expressed in terms of background stain and printing durability) according to the following test methods. The results obtained are shown in Table 6 below.

1) Smoothness of Photoconductive Layer

The smoothness (sec/cc) was measured using a Beck's smoothness tester manufactured by Kumagaya Riko K. K. under an air volume condition of 1 cc.

2) Mechanical Strength of Photoconductive Layer

The surface of the light-sensitive material was repeatedly (1000 times) rubbed with emery paper (#1000) under a load of 55 g/cm$^2$ using a Heidon 14 Model surface testing machine (manufactured by Shinto Kagaku K. K.). After dusting, the abrasion loss of the photoconductive layer was measured to obtain film retention (%).

3) Electrostatic Characteristics

The sample was charged with a corona discharge to a voltage of −6 kV for 20 seconds in a dark room 20° C. and 65% RH using a paper analyzer "Paper Analyzer SP-428" manufactured by Kawaguchi Denki K. K. Ten seconds after the corona discharge, the surface potential $V_{10}$ was measured. The sample was allowed to stand in dark for an additional 180 seconds, and the potential $V_{190}$ was measured. The dark decay retention (DRR; %), i.e., percent retention of potential after dark decay for 180 seconds, was calculated from the following equation:

$$DRR\ (\%) = (V_{190}/V_{10}) \times 100$$

Separately, the sample was Charged to −500 V with a corona discharge and then exposed to monochromatic light having a wavelength of 785 nm, and the time required for decay of the surface potential $V_{10}$ to one-tenth was measured to obtain an exposure $E_{1/10}$ (erg/cm$^2$).

Further, the sample was charged to −500 V with a corona discharge in the same manner as described for the measurement of $E_{1/10}$, then exposed to monchromatic light having a wavelength of 785 nm, and the time required for decay of the surface potential $V_{10}$ to one-hundredth was measured to obtain an exposure $E_{1/100}$ (erg/cm$^2$).

The measurements were conducted under conditions of 20° C. and 65% RH (hereinafter referred to as Condition I) or 30° C. and 80% RH (hereinafter referred to as Condition II).

4) Image Forming Performance

After the samples were allowed to stand for one day under Condition I or II, each sample was charged to −5 kV and exposed to light emitted from a gallium-aluminum-arsenic semi-conductor laser (oscillation wavelength: 780 nm; output: 2.8 mW) at an exposure amount of 50 erg/cm$^2$ (on the surface of the photoconductive layer) at a pitch of 25 μm and a scanning speed of 300 m/sec. The thus formed electrostatic latent image was developed with a liquid developer "ELP-T"

produced by Fuji Photo Film Co., Ltd., followed by fixing. The duplicated image was visually evaluated for fog and image quality. The original used for the duplication was composed of letters by a word processor and a cutting of letters on straw paper pasted up thereon.

5) Contact Angle With Water

The sample was passed once through an etching processor using an oil-desensitizing solution "ELP-EX" produced by Fuji Photo Film Co., Ltd. to render the surface of the photoconductive layer oil-desensitive. On the thus oil-desensitized surface was placed a drop of 2 μl of distilled water, and the contact angle formed between the surface and water was measured using a goniometer.

6) Printing Durability

The sample was processed in the same manner as described in 4) above to form toner images, and the surface of the photoconductive layer was subjected to oil-desensitization treatment under the same conditions as in 5) above. The resulting lithographic printing plate was mounted on an offset printing machine "Oliver Model 52", manufactured by Sakurai Seisakusho K. K., and printing was carried out. The number of prints obtained until background stains in the non-image areas appeared or the quality of the image areas was deteriorated was taken as the printing durability. The larger the number of the prints, the higher the printing durability.

proven conclusively, these results appear to be due to sufficient adsorption of the binder resin onto the photoconductive substance and sufficient covering of the surface of the particles with the binder resin. For the same reason, when it was used as an offset master plate precursor, oil-desensitization of the offset master plate precursor with an oil-desensitizing solution was sufficient to render the non-image areas satisfactorily hydrophilic, as shown by a small contact angle of 10° or less with water. On practical printing using the resulting master plate, no background stains were observed in the prints.

In the light-sensitive material of the present invention using the resin (A') containing a methacrylate component having a specific substituent, the electrophotographic characteristics, particularly photosensitivities of $E_{1/10}$ and $E_{1/100}$ were furthermore improved, as shown in Example 2.

The sample of Comparative Example A had a reduced DRR and an increased $E_{1/10}$ and exhibited insufficient photoconductivity under the Conditions of high temperature and high humidity.

The sample of Comparative Example B had almost satisfactory values on the electrostatic characteristics of $V_{10}$ and DRR under the normal condition. However, with respect to $E_{1/10}$ and $E_{1/100}$, the values obtained were more than twice those of the light-sensitive material according to the present invention. Further, under the conditions of high temperature and high humidity, the tendency of degradation of DRR and $E_{1/10}$ was

TABLE 6

| | Example 1 | Example 2 | Comparative Examples A | Comparative Examples B |
|---|---|---|---|---|
| Surface Smoothness (sec/cc) | 130 | 125 | 96 | 130 |
| Film Strength (%) | 95 | 96 | 88 | 85 |
| Electrostatic Characteristics: | | | | |
| $V_{10}$ (−V): | | | | |
| Condition I | 555 | 605 | 445 | 540 |
| Condition II | 545 | 600 | 405 | 500 |
| DRR (%): | | | | |
| Condition I | 81 | 87 | 57 | 80 |
| Condition II | 78 | 85 | 35 | 78 |
| $E_{1/10}$ (erg/cm$^2$): | | | | |
| Condition I | 38 | 16 | 100 | 45 |
| Condition II | 35 | 18 | 200 or more | 43 |
| $E_{1/100}$ (erg/cm$^2$): | | | | |
| Condition I | 49 | 32 | 200 or more | 63 |
| Condition II | 61 | 38 | 200 or more | 76 |
| Image-Forming Performance: | | | | |
| Condition I | Good | Very Good | Poor (reduced $D_m$, scraches of fine lines or letters) | Poor (reduced $D_m$, slight background fog) |
| Image-Forming Performance: | | | | |
| Condition II | Good | Very Good | Very poor (indiscriminative images from background fog) | Poor (background fog, reduced $D_m$) |
| Contact Angle With Water (°) | 10 or less | 10 or less | 15 to 30 (varied widely) | 10 |
| Printing Durability: | 10,000 or more | 10,000 or more | Background stains from the start of printing | 7,000 |

As can be seen from the results shown in Table 6, each of the light-sensitive materials according to the present invention had good surface smoothness and film strength of the photoconductive layer, and good electrostatic characteristics. The duplicated image formed was clear and free from background fog in the non-image area. While the reason therefor has not been observed. Moreover, the $E_{1/100}$ value was further increased under such conditions.

The value of $E_{1/100}$ indicated an electrical potential remaining in the non-image areas after exposure at the practice of image formation. The smaller this value, the less the background stains in the non-image areas. More specifically, it is required that the remaining potential is decreased to −10V or less. Therefore, an amount of exposure necessary to make the remaining potential below −10 V is an important factor. In the scanning exposure system using a semiconductor laser beam, it is quite important to make the remaining potential below −10V by a small exposure amount in view of a design for an optical system of a duplicator (such as cost of the device, and accuracy of the optical system).

When the sample of Comparative Example B was actually imagewise exposed by a device of a small amount of exposure, the occurrence of background fog in the non-image areas was observed.

Furthermore, when it was used as an offset master plate precursor, the printing durability was up to 7,000 prints under the printing conditions under which the sample according to the present invention provided more than 10,000 good prints.

From all these consideration, it is thus clear that an electrophotographic light-sensitive material satisfying both requirements of electrostatic characteristics and printing suitability can be obtained only in case of using the binder resin according to the present invention.

EXAMPLES 3 TO 19

An electrophotographic light-sensitive material was prepared in the same manner as described in Example 1, except for replacing Resin (A-1) and Resin (B-1) with each of Resins (A) and (B) shown in Table 7 below, respectively.

The performance properties of the resulting light-sensitive materials were evaluated in the same manner as described in Example 1. The results obtained are shown in Table 7 below. The electrostatic characteristics in Table 7 are those determined under Condition II (30° C. and 80% RH).

TABLE 7

| Example No. | Resin (A) | Resin (B) | $V_{10}$ (−V) | DRR (%) | $E_{1/10}$ (erg/cm$^2$) | $E_{1/100}$ (erg/cm$^2$) |
|---|---|---|---|---|---|---|
| 3 | A-3 | B-1 | 555 | 82 | 20 | 45 |
| 4 | A-5 | B-1 | 585 | 85 | 18 | 40 |
| 5 | A-8 | B-2 | 590 | 84 | 17 | 38 |
| 6 | A-9 | B-3 | 565 | 83 | 19 | 42 |
| 7 | A-10 | B-4 | 550 | 80 | 21 | 48 |
| 8 | A-11 | B-5 | 555 | 82 | 20 | 47 |
| 9 | A-12 | B-8 | 550 | 79 | 22 | 50 |
| 10 | A-13 | B-9 | 550 | 79 | 23 | 55 |
| 11 | A-17 | B-10 | 555 | 80 | 21 | 48 |
| 12 | A-18 | B-11 | 575 | 83 | 19 | 40 |
| 13 | A-19 | B-17 | 580 | 84 | 18 | 39 |
| 14 | A-20 | B-18 | 555 | 81 | 21 | 46 |
| 15 | A-21 | B-19 | 570 | 82 | 19 | 43 |
| 16 | A-22 | B-22 | 560 | 82 | 20 | 48 |
| 17 | A-23 | B-26 | 550 | 80 | 21 | 50 |
| 18 | A-24 | B-23 | 560 | 83 | 17 | 41 |
| 19 | A-25 | B-21 | 565 | 84 | 18 | 38 |

As is apparent from the results shown in Table 7, good characteristics similar to those in Example 1 are obtained.

Further, when these electrophotographic light-sensitive materials were employed as offset master plate precursors under the same printing condition as described in Example 1, more than 10,000 good prints were obtained respectively.

It can be seen from the results described above that each of the light-sensitive materials according to the present invention was satisfactory in all aspects of photoconductive layer surface smoothness, film strength, electrostatic characteristics, and printing suitability.

EXAMPLES 20 TO 27

An electrophotographic light-sensitive material was prepared in the same manner as described in Example 1, except for replacing 6 g of Resin (A-1) with 6.5 g each of Resins (A) shown in Table 8 below, replacing 34 g of Resin (B-1) with 33.5 g each of Resins (B) shown in Table 8 below, and replacing 0.02 g of Cyanine Dye (I) with 0.018 g of Cyanine Dye (II) shown below.

TABLE 8

Cyanine Dye (II):

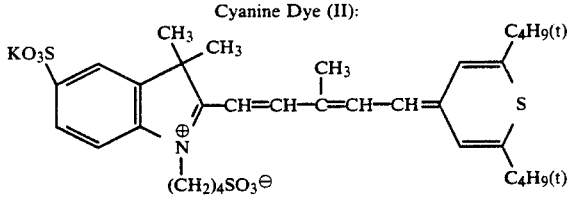

| Example No. | Resin (A) | Resin (B) |
|---|---|---|
| 20 | A-1 | B-2 |
| 21 | A-4 | B-2 |
| 22 | A-8 | B-3 |
| 23 | A-16 | B-7 |
| 24 | A-19 | B-18 |
| 25 | A-20 | B-22 |
| 26 | A-22 | B-24 |
| 27 | A-24 | B-27 |

As the results of the evaluation as described in Example 1, it can be seen that each of the light-sensitive materials according to the present invention is excellent in charging properties, dark charge retention, and photosensitivity, and provides a clear duplicated image free from background fog even when processed under severe conditions of high temperature and high humidity (30° C. and 80% RH). Further, when these materials were employed as offset master plate precursors, more than 10,000 prints of clear images free from background stains were obtained respectively.

EXAMPLE 28

A mixture of 6.5 g of Resin (A-1), 33.5 g of Resin (B-9), 200 g of zinc oxide, 0.03 g of uranine, 0.075 g of Rose Bengale, 0.045 g of Bromophenol Blue, 0.1 g of phthalic anhydride, and 240 g of toluene was dispersed in a ball mill for 2 hours to prepare a coating composition for a light-sensitive layer. The coating composition was coated on paper subjected to electrically conductive treatment, with a wire bar to a dry coverage of 20 g/m$^2$, followed by drying at 110° C. for 30 seconds. The coated material was allowed to stand in a dark place at 20° C. and 65% RH (relative humidity) for 24 hours to prepare an electrophotographic light-sensitive material.

COMPARATIVE EXAMPLE C

An electrophotographic light-sensitive material was prepared in the same manner as described in Example 28, except for using 40 g of Resin (P-1) described in Comparative Example A above in place of 6.5 g of Resin (A-1) and 33.5 g of Resin (B-9).

COMPARATIVE EXAMPLE D

An electrophotographic light-sensitive material was produced in the same manner as described in Example 28, except for using 6.5 g of Resin (P-2) having the structure shown below in place of 6.5 g of Resin (A-1) and 33.5 g of Resin (P-3) described in Comparative Example B above in place of 33.5 g of Resin (B-9).

Resin (P-2):

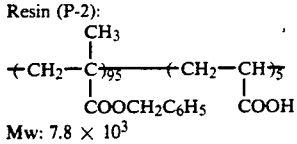

Mw: $7.8 \times 10^3$

Each of the light-sensitive materials obtained in Example 28 and Comparative Examples C and D was evaluated for film properties in terms of surface smoothness and mechanical strength; electrostatic characteristics; image forming performance; image forming performance under environmental conditions of 30° C. and 80% RH; oil-desensitivity when used as an offset master plate precursor (expressed in terms of contact angle of the layer with water after oil-desensitization treatment); and printing suitability (expressed in terms of background stain and printing durability) according to the test methods as described in Example 1, except that the electrostatic characteristics and image forming performance were evaluated according to the following test methods.

7) Electrostatic Characteristics

The sample was charged with a corona discharge to a voltage of −6 kV for 20 seconds in a dark room at 20° C. and 65% RH using a paper analyzer "Paper Analyzer SP-428" manufactured by Kawaguchi Denki K. K. Ten seconds after the corona discharge, the surface potential $V_{10}$ was measured. The sample was allowed to stand in the dark for an additional 60 seconds, and the potential $V_{70}$ was measured. The dark decay retention (DRR; %), i.e., percent retention of potential after dark decay for 60 second, was calculated from the following equation:

$$DRR\ (\%) = (V_{70}/V_{10}) \times 100$$

Separately, the sample was charged to −500 V with a corona discharge and then exposed to visible light of 2.0 lux, and the time required for decay of the surface potential $V_{10}$ to one-tenth was measured to obtain an exposure $E_{1/10}$ (lux·sec).

Further, the Sample was charged to −500 V with a corona discharge in the same manner as described for the measurement of $E_{1/10}$, then exposed to visible light of 2.0 lux, and the time required for decay of the surface potential $V_{10}$ to one-hundredth was measured to obtain an exposure $E_{1/100}$ (lux·sec).

The measurements were conducted under Conditions of 20° C. and 65% RH (hereinafter referred to as Condition I) or 30° C. and 80% RH (hereinafter referred to as Condition II).

8). Image Forming Performance

After the samples were allowed to stand for one day under Condition I or II, each sample was processed using an automatic plate making machine "ELP 404V" (manufactured by Fuji Photo Film Co., Ltd.) using a toner "ELP-T" (manufactured by Fuji Photo Film Co., Ltd.) under condition I or II. The duplicated image thus obtained was visually evaluated for fog and image quality. The original used for the duplication was composed of letters by a word processor and a cutting of letters on straw paper pasted up thereon.

The results obtained are shown in Table 9 below.

TABLE 9

| | Example 28 | Comparative Examples C | Comparative Examples D |
|---|---|---|---|
| Surface Smoothness (sec/cc) | 98 | 91 | 93 |
| Film Strength (%) | 98 | 90 | 84 |
| Electrostatic Characteristics: | | | |
| $V_{10}$ (−V): | | | |
| Condition I | 560 | 545 | 555 |
| Condition II | 550 | 480 | 540 |
| DRR (%): | | | |
| Condition I | 92 | 88 | 92 |
| Condition II | 91 | 55 | 89 |
| $E_{1/10}$ (erg/cm$^2$): | | | |
| Condition I | 8.6 | 21 | 13 |
| Condition II | 8.6 | 17 | 10 |
| $E_{1/100}$ (erg/cm$^2$): | | | |
| Condition I | 15 | 76 | 22 |
| Condition II | 14 | 65 | 16.5 |
| Image-Forming Performance: | | | |
| Condition I | Good | No good (slight background fog) | Good Good |
| Image-Forming Performance: | | | |
| Condition II | Good | Very poor (reduced $D_m$, scraches of letters) | Poor (scraches of fine lines, slight background fog) |
| Contact Angle With Water (°) | 10 or less | 15 to 30 (varied widely) | 10 |
| Printing Durability: | 10,000 or more | Background stains from the start of printing | 7,000 |

As can be seen from the results shown in Table 9, the light-sensitive material according to the present invention had sufficient surface smoothness and film strength of the photoconductive layer, and good electrostatic characteristics which were hardly changed depending on the fluctuation of environmental conditions. The duplicated image obtained was clear and free from background fog.

On the contrary, the sample of Comparative Example C using a known random type copolymer exhibited the severe degradation of electrostatic characteristics, particularly, under the conditions of high temperature and high humidity. Further, the duplicated image obtained was on the level insufficient for practical use.

The sample of Comparative Example D was inferior to the sample according to the present invention in its electrostatic characteristics, particularly, in the fluctuations of $E_{1/100}$ value due to the change of environmental conditions. In the duplicated image of the original composed of letters by a word processor and cutting of letters on straw paper, scratches of fine lines and background stains were observed under the conditions of high temperature and high humidity.

Furthermore, when each of the samples was used as an offset master plate precursor, the sample of Comparative Example C exhibited background stains on the print from the start of printing, and the sample of Comparative Example D provided up to 7,000 prints of a clear image, while the sample of Example 28 according to the present invention could provide more than 10,000 prints of a clear image free from background stains.

From all these considerations, it is clear that only the electrophotographic light-sensitive material according to the present invention is excellent in view of both smoothness and film strength of photoconductive layer, electrostatic characteristics and printing suitability.

EXAMPLES 29 TO 34

An electrophotographic light-sensitive material was prepared in the same manner as described in Example 28, except for replacing Resin (A-1) and Resin (B-9) with each of 6.0 g of Resin (A) and 34.0 g of Resin (B) shown in Table 10 below, respectively.

TABLE 10

| Example No. | Resin (A) | Resin (B) |
|---|---|---|
| 29 | A-2 | B-14 |
| 30 | A-7 | B-19 |
| 31 | A-8 | B-21 |
| 32 | A-14 | B-23 |
| 33 | A-26 | B-27 |
| 34 | A-27 | B-31 |

As the results of the evaluation of each sample in the manner as described above, it can be seen that each of the light-sensitive materials according to the present invention is excellent in charging properties, dark charge retention, and photosensitivity, and provides a clear duplicated image free from background fog even when processed under severe conditions of high temperature and high humidity (30° C. and 80% RH). Further, when these materials were employed as offset master plate precursors, more than 10,000 prints of a clear image free from background stains were obtained respectively.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a support having provided thereon at least one photoconductive layer containing an inorganic photoconductive substance and a binder resin, wherein the binder resin comprises at least one resin (A) having a weight average molecular weight of from $1\times10^3$ to $2\times10^4$ and containing not less than 30% by weight of a copolymer component corresponding to a repeating unit represented by the general formula (I) described below and having at least one acidic group selected from the group consisting of $-PO_3H_2$, $-SO_3H$, $-COOH$, $-OH$

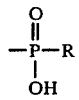

(wherein R is a hydrocarbon group or —OR' (wherein R' is a hydrocarbon group)) and a cyclic acid anhydride-containing group at one of the terminals of the main chain thereof;

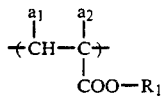

(I)

wherein $a_1$ and $a_2$ each is a hydrogen atom, a halogen atom, a cyano group or a hydrocarbon group; and $R_1$ is a hydrocarbon group; and at least one copolymer resin (B) having a weight average molecular weight of from $5\times10^4$ to $1\times10^6$ and formed from at least a monofunctional macromonomer (M) having a weight average molecular weight of not more than $2\times10^4$ and a monomer represented by the general formula (V) described below, said macromonomer (M) formed from at least one polymerizable component corresponding to a repeating unit represented by the general formula (IVa) and (IVb) described below, and at least one polymerizable component containing at least one acidic group selected from $-COOH$, $-PO_3H_2$, $-SO_3H$, $-OH$,

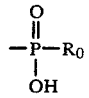

(wherein $R_0$ is a hydrocarbon group or $-OR_0'$ (wherein $R_0'$ is a hydrocarbon group)), —CHO, and an acid anhydride-containing group, and said macromonomer (M) having a polymerizable double bond group represented by the general formula (III) described below bonded to only one terminal of the main chain of the polymer;

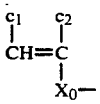

(III)

wherein $X_0$ is —COO, —OCO—, $-CH_2OCO-$, $-CH_2COO-$, —O—, $-SO_2$, —CO—, —CONHCOO—, —CONHCONH—,

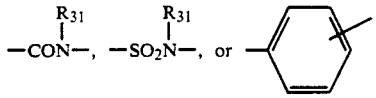

(wherein $R_{31}$ is a hydrogen atom, a hydrocarbon group), and $c_1$ and $c_2$, which may be the same or different, each is a hydrogen atom, a halogen atom, a cyano group, a hydrocarbon group, —COO—$Z_1$ or —COO—$Z_1$ bonded via a hydrocarbon group (wherein $Z_1$ is a hydrogen atom or a hydrocarbon group which may be substituted;

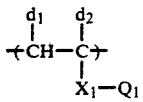

(IVa)

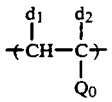

(IVb)

wherein $X_1$ has the same meaning as $X_0$ in the general formula (III); $Q_1$ is an aliphatic group having from 1 to 18 carbon atoms or an aromatic group having from 6 to 12 carbon atoms; $d_1$ and $d_2$, which may be the same or different, have the same meaning as $c_1$ and $c_2$ in the general formula (III); and $Q_0$ is —CN, —$CONH_2$, or

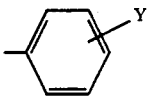

(wherein Y is a hydrogen atom, a halogen atom, an alkoxy group or —$COOZ_2$ (wherein $Z_2$ is an alkyl group, an aralkyl group, or an aryl group));

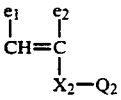

(V)

wherein $X_2$ has the same meaning as $X_1$ in the general formula (IVa); $Q_2$ has the same meaning as $Q_1$ in the general formula (IVa); and $e_1$ and $e_2$, which may be the same or different, have the same meaning as $c_1$ and $c_2$ in the general formula (III), and wherein the content of the acidic group bonded to the terminal of the polymer main chain in the resin (A) is from 0.5% by weight to 15% by weight based on resin (A).

2. An electrophotographic light-sensitive material as claimed in claim 1, wherein the copolymer component corresponding to a repeating unit represented by the general formula (I) is a copolymer component corresponding to a repeating unit represented by the following general formula (IIa) or (IIb):

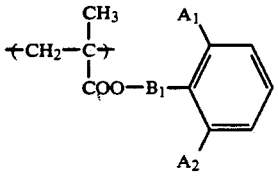

(IIa)

-continued

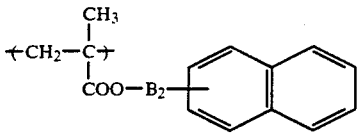

(IIb)

wherein $A_1$ and $A_2$ each represents a hydrogen atom, a hydrocarbon group having from 1 to 10 carbon atoms, a chlorine atom, a bromine atom, —$COD_1$ or —$COOD_2$, wherein $D_1$ and $D_2$ each represents a hydrocarbon group having from 1 to 10 carbon atoms, provided that both $A_1$ and $A_2$ do not simultaneously represent hydrogen atoms; and $B_1$ and $B_2$ each represents a mere chemical bond or a linking group containing from 1 to 4 linking atoms, which connects —COO— and the benzene ring.

3. An electrophotographic light-sensitive material as claimed in claim 1, wherein a content of the copolymer component corresponding to the repeating unit represented by the general formula (I) in the resin (A) is from 50% to 97% by weight.

4. An electrophotographic light-sensitive material as claimed in claim 2, wherein the linking group containing from 1 to 4 linking atoms represented by $B_1$ or $B_2$ is

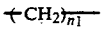

($n_1$ represents an integer of 1, 2 or 3), —$CH_2OCO$—, —$CH_2CH_2OCO$—,

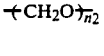

($n_2$ represents an integer of 1 or 2), or —$CH_2CH_2O$—.

5. An electrophotographic light-sensitive material as claimed in claim 1, wherein the acidic group contained in the copolymerizable component of the resin (A) is selected from —$PO_3H_2$ —$SO_3H$, —COOH,

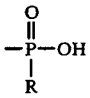

(wherein R represents a hydrocarbon group or OR' wherein R' represents a hydrocarbon group), and a cyclic acid anhydride-containing group.

6. An electrophotographic light-sensitive material as claimed in claim 1, wherein the resin (A) further contains from 1% to 20% by weight of a copolymer component having a heat- and/or photocurable functional group.

7. An electrophotographic light-sensitive material as claimed in claim 1, wherein a content of the macromonomer in the resin (B) is from 1% to 70% by weight.

8. An electrophotographic light-sensitive material as claimed in claim 1, wherein a component of the monomer represented by the general formula (V) in the resin (B) is from 30% to 99% by weight.

9. An electrophotographic light-sensitive material as claimed in claim 1, wherein the resin (B) has at least one acidic group selected from —$PO_3H_2$, —$SO_3H$, —COOH, —OH,

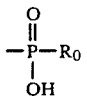

(wherein $R_0$ represents a hydrocarbon group or $OR_0'$, wherein $R_0'$ represents a hydrocarbon group), and a cyclic acid anhydride group-containing group at the terminal of the main chain thereof.

10. An electrophotographic light-sensitive material as claimed in claim 1, wherein the resin (B) further contains a copolymer component having a heat- and/or photocurable group.

11. An electrophotographic light-sensitive material as claimed in claim 1, wherein a weight ratio of the resin (A) to the resin (B) is 5 to 60 : 95 to 40.

* * * * *